US005393653A

United States Patent [19]

Kawai

[11] Patent Number: 5,393,653

[45] Date of Patent: Feb. 28, 1995

[54] METHOD FOR PREPARING A SILVER HALIDE EMULSION AND A SILVER HALIDE COLOR PHOTOGRAPHIC LIGHT-SENSITIVE MATERIAL CONTAINING THE EMULSION

[75] Inventor: Hiroshi Kawai, Kanagawa, Japan

[73] Assignee: Fuji Photo Film Co., Ltd., Minami-ashigara, Japan

[21] Appl. No.: 935,905

[22] Filed: Aug. 27, 1992

[30] Foreign Application Priority Data

Sep. 4, 1991 [JP] Japan ..... 3-250307

[51] Int. Cl.[6] ..... G03C 1/015; G03C 1/035; G03C 1/07

[52] U.S. Cl. ..... 430/569; 430/567

[58] Field of Search ..... 430/567, 569

[56] References Cited

U.S. PATENT DOCUMENTS

| | | | |
|---|---|---|---|
| 4,820,624 | 4/1989 | Hasebe et al. | 430/569 |
| 4,865,962 | 9/1989 | Hasebe et al. | 430/569 |
| 5,061,615 | 10/1991 | Kase et al. | 430/569 |
| 5,200,310 | 4/1993 | Ohshima | 430/567 |

FOREIGN PATENT DOCUMENTS 0273430 7/1988 European Pat. Off. .

0341728A 11/1989 European Pat. Off. .

*Primary Examiner*—Charles L. Bowers, Jr.
*Assistant Examiner*—Mark F. Huff
*Attorney, Agent, or Firm*—Burns, Doane, Swecker & Mathis

[57] ABSTRACT

A method for preparing a silver halide emulsion. The method comprises supplying bromine and/or bromine ion at a plurality of processing stages to silver halide host grains to form a phase rich in silver bromide in the vicinity of the apexes of the grains. The host grains are substantially of a cube or octahedron and have a silver chloride content of about 95 mole % or more, and a silver bromide content of about 0 to about 5 mole %. The bromine and/or bromine ion is supplied at the plurality of stages by adding and mixing in a reaction vessel at least one of (i) a water soluble bromine compound, (ii) silver halide grains having a smaller average grain size and a larger silver bromide content than the silver halide host grains, and (iii) a bromine or bromine ion precursor represented by a certain formula (S). In at least one stage of the plurality of processing stages the bromine and/or bromine ion is supplied when the formation of the silver bromide-rich phase is at least 80% complete in the previous stage.

26 Claims, No Drawings

METHOD FOR PREPARING A SILVER HALIDE EMULSION AND A SILVER HALIDE COLOR PHOTOGRAPHIC LIGHT-SENSITIVE MATERIAL CONTAINING THE EMULSION

FIELD OF THE INVENTION

The present invention relates to a silver halide color photographic light-sensitive material. More specifically, the invention relates to a silver halide color photographic light-sensitive material which has high sensitivity, hard gradation, and excellent clearance in a highlight portion.

BACKGROUND OF THE INVENTION

Currently there are a large variety of commercially available light-sensitive materials and image-forming methods to be used therewith. Of those light-sensitive materials, the materials used in markets where large numbers of finished prints are required in a short period of time, silver bromide or silver chloride emulsions containing substantially no silver iodide have been used.

In recent years, requirements for improvements in rapid processing performance for color photographic paper have been increasing thereby increasing the amount of research associated with those requirements. It is known that an increase in the amount of silver chloride content in a silver halide emulsion results in a marked improvement in developing speed, and there has been a movement in the market to convert to the use of higher silver chloride content emulsions for color photographic paper. However, silver halide emulsions having high silver chloride content have drawbacks in that it is difficult to obtain a high sensitivity and a hard gradation with conventional chemical sensitization.

There have been several attempts to provide high silver chloride emulsions with high sensitivity. For example, a technique is disclosed in JP-A-64-26837 (the term "JP-A" as used herewith means an unexamined published Japanese patent application), where a silver bromide rich phase is formed in the vicinity of an apex of a silver halide host grain to achieve a high sensitivity. Methods for forming a silver bromide rich phase in the vicinity of an apex of a silver halide host grain include, for example, the method in which a water soluble bromine compound is added to a silver halide host grain described in JP-A-62-7040; a method in which silver halide grains having smaller average grain sizes and larger silver bromide contents than those of silver halide host grains, are added to the silver halide host grains to form a silver bromide rich phase is described in JP-A-64-26840; and a method in which bromine or a bromine controlled release agent is added is described in JP-A-1-285942. However, a "clearance", e.g., a photograph with a sharp image taken even in a bright landscape, in a highlight portion is inferior with such materials compared with those using a high silver bromide emulsion.

SUMMARY OF THE INVENTION

An object of the present invention is to provide a method for preparing a silver halide photographic emulsion which improves a clearance in a highlight portion without substantially reducing sensitivity, and to provide a silver halide photographic light-sensitive material containing such a silver halide emulsion.

The extensive investigations by the inventors have resulted in the discovery that a silver halide photographic emulsion which improves clearance in a highlight portion without substantially reducing sensitivity, can be prepared by a certain novel method for preparing the silver halide emulsion. The method comprises that there exists a process in which supplying bromine and/or a bromine ion at a plurality of processing stages to form a phase rich in silver bromide in the vicinity of the apexes of the grains. The silver halide host grains are substantially of a cube or a tetradecahedron with a silver chloride content of 95 mole % or more and a silver bromide content of 0 to 5 mole %. According to the process, the bromine and/or bromine ion is supplied by adding and mixing in a reaction vessel at least one of (i) a water soluble bromine compound, (ii) silver halide grains having a smaller average grain size and larger silver bromide content than the silver halide host grains, and (iii) a bromine or bromine ion precursor represented by the following formula (S):

$$Y-\left(\begin{array}{c}R_1\\ |\\ C\\ |\\ R_2\end{array}\right)_n-Br; \qquad (S)$$

wherein Y represents an organic group having a Hammett's $\sigma_p$ value of 0 or more; $R_1$ and $R_2$, which may be the same or different, each represent a hydrogen atom, an alkyl group, an alkenyl group, an aralkyl group, an aryl group, and a group represented by Y, provided that $R_1$and Y may be combined to form a heterocyclic ring; and n represents an integer of 1 to 3. In at least one of the plurality of processing stages the bromine and/or bromine ion is supplied when the formation of the silver bromide-rich phase is complete by 80% or more at a preceding stage.

DETAILED DESCRIPTION OF THE PREFERRED EMBODIMENTS OF THE INVENTION

According to the present invention, "the formation of the silver bromide rich phase is complete by 80% or more" means that the amount of the bromine and/or bromine ion remaining in the reaction vessel without being used for forming the sliver bromide rich phase is less than 20% of the amount of the bromine and/or bromine ion existing therein just after being supplied for forming the silver bromide rich phase. The amount of the bromine and/or bromine ion is represented by the concentration of the bromine and/or bromine ion when the bromine and/or bromine ion are supplied from the water soluble bromine compound, the bromine or bromine ion precursor, and represented by the whole volume of the undissolved grains when the bromine and/or bromine ion are supplied from silver halide grains having a smaller average grain size and larger silver bromide content than the silver halide host grains.

The bromine and/or bromine ion are supplied at plural stages to increase the number of the interfaces formed by the silver halide host grains and the silver bromide rich phase present in a vicinity of an apex of the silver halide host grain, and to offset any defects generated on the interfaces to maintain high sensitivity. Further, there can be reduced a distribution of any defect between the grains, which is generated on the interfaces formed by the silver halide host grain and silver bromide rich phase present in the vicinity of the apex of the silver halide host grain. As a result, a gradation in a highlight portion can be hardened to thereby improve a "clearance".

Preferred are the following methods for supplying bromine and/or a bromine ion according to the present invention:

(1) a method where a water soluble compound such as potassium bromide is added and mixed;

(2) a method where silver halide grains having a smaller average grain size and a larger silver bromide content than the silver halide host grains are added and mixed; and (3) a method where a bromine or bromine ion precursor represented by formula (S) is added and mixed.

The above methods may be used alone, or combined, for supplying bromine and/or the bromine ion. Further, the silver bromide content in a silver bromide rich phase formed by the supply of bromine and/or a bromine ion at a particular stage is preferably higher than that of its preceding stage; preferably higher by 5 mole % or more. Ultimately, the silver bromide content in the silver bromide rich phase is preferably 30 mole % or more and 70 mole % or less, more preferably 35 mole % or more and 60 mole % or less.

As noted above with respect to formula (S), Y represents an organic group having a Hammett's $\sigma_p$ value of 0 or more. The Hammett's $\sigma_p$ values are described at page 96 of *Structural Activity Correlation of Pharmaceuticals* published by Nankoh Doh (1979) and the substituents can be selected based on this table. There can be given as Y, preferably a halogen atom such as a bromine atom, a chlorine atom or a fluorine atom, a trifluoromethyl group, a cyano group, a formyl group, a carboxylic acid group, a sulfonic acid group, a carbamoyl group such as an unsubstituted carbamoyl or diethylcarbamoyl, an acyl group such as an acetyl or benzoyl, an oxycarbonyl group such as a methoxycarbonyl or ethoxycarbonyl, a sulfonyl group such as a methanesulfonyl or benzenesulfonyl, a sulfonyloxy group such as a methanesulfonyloxy, a carbonyloxy group such as an acetoxy, a sulfamoyl group such as an unsubstituted sulfamoyl or dimethylsulfamoyl, and a heterocyclic group such as a 2-thienyl, 2-benzoxazolyl, 2-benzothiazolyl, 1-methyl-2-benzoimidazolyl, 1-tetrazolyl, or 2-quinolyl.

$R_1$ and $R_2$ each represent a hydrogen atom, a substituted or unsubstituted alkyl group such as a methyl, ethyl, n-propyl, or hydroxyethyl, an alkenyl group such as a vinyl or allyl, an aralkyl group such as a benzyl, an aryl group such as a phenyl or p-tolyl, and a group such as that represented by Y, provided that Y and $R_1$ may be combined to form a heterocyclic group such as an imidazolyl group, a pyridyl group, a thienyl group, a quinolyl group, or a tetrazolyl group. $R_1$ and $R_2$ may be the same or different. The alkyl group, alkenyl group, aralkyl group and aryl group represented by $R_1$ and $R_2$ may include substituted group thereof.

In Formula (S), Y is preferably a cyano group, a carboxylic acid group, a carbamoyl group, an acyl group, a sulfonyl group, an oxycarbonyl group, a sulfamoyl group, or a heterocyclic group; $R_1$ and $R_2$ each represent a hydrogen atom and the group represented by Y; and n represents an integer of 1 to 2.

Specific examples of compounds represented by formula (S) are shown below, but useful compounds are not limited thereto.

$BrCH_2COOH$ (S-1)

-continued $Br(CH_2)_2COOH$ (S-2)

$Br(CH_2)_3COOH$ (S-3)

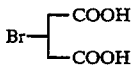
(S-4)

$BrCH_2CN$ (S-5)

$Br(CH_2)_2CONH_2$ (S-6)

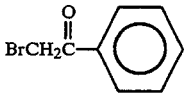
(S-7)

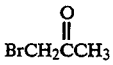
(S-8)

$Br(CH_2)_2SO_2CH_3$ (S-9)

$BrCH(CH_3)CH_2SO_2CH_3$ (S-10)

$BrCH_2COOCH_3$ (S-11)

$BrCH_2CH_2SO_2NH_2$ (S-12)

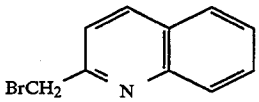
(S-13)

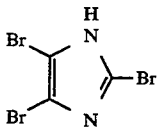
(S-14)

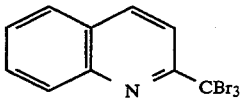
(S-15)

$BrCH_2CH_2SO_3Na$ (S-16)

Suitable compounds represented by formula (S) can be readily obtained as they are commercially available.

The compound represented by formula (S) is preferably added in an amount ranging from 0.1 to 5 mole %, more preferably 0.2 to 3 mole %, based on a whole silver halide amount.

"Vicinity of an apex" as used herein means a range present within an area of a square preferably having a length of about $\frac{1}{3}$, more preferably 1/5, of a diameter of a circle having the same area as a projected area of a silver halide grain of a cube or a regular crystal corresponding to a cube, wherein one apex thereof is owned jointly with an apex (an intersection point of the edges of a cube or regular crystal grain regarded as a cube) of the grain.

A method for preparing a preferred silver halide emulsion according to the present invention will be explained in detail below.

(1) The crystals of the silver halide grains used for preparing the emulsion according to the present invention are crystal grains of a cube or tetradecahedron substantially having a (100) plane (these may have a round corner and further more planes), and having a halogen composition in which 2 mole % or less, including none of silver bromide is present, and at least 95 mole % thereof is silver chloride. Particularly preferred are the silver halide crystals containing at least 99 mole % of silver chloride and 1 mole % or less of silver bromide, or pure silver chloride crystals. An average grain size of these silver halide grains is preferably 0.2 to 2 μm and the distribution status thereof is preferably a monodispersion.

A monodispersed emulsion useful according to the present invention is an emulsion having a grain size distribution with a fluctuation coefficient (S/average r) of a silver halide grain size of 0.25 or less, preferably 0.15 or less, wherein the average r is an average grain size and S is a standard deviation of the grain sizes. That is, given that a grain size of respective emulsion grains is "ri", and the number thereof is "ni", an average grain size r is defined by:

$$r = \frac{\Sigma ni \cdot ri}{\Sigma ni};$$

and a standard deviation S thereof is defined by:

$$S = \sqrt{\frac{\Sigma(\bar{r} - ri)^2 \cdot ni}{\Sigma ni}}.$$

Each grain size referred to according to the present invention is a projected area-corresponding diameter, the area of a grain being projected by photographing the grain with a method, usually by photographing with an electron microscope, well known in the art such as that described in "The Theory of the Photographic Process" written by T. H. James et al, third edition, pp. 36 to 43, published by MacMillan Co., Ltd. (1966). The projected area-corresponding diameter of a grain is defined by a diameter of a circle having the same area as a projected area of the silver halide grain as described in the above publication.

(2) Next, bromine ions or high silver bromide fine grains are supplied to the above host silver halide grains to deposit thereon a new silver halide phase which is rich in silver bromide. In case of bromine ions, this process proceeds with a so-called "halogen conversion" process in which an exchange reaction takes place with the halogen ions present on the host silver halide grains. In case of the high silver bromide fine grains, the process proceeds with a reaction called as "recrystallization" where crystals with a more stable composition are formed between the host silver halide grains and high silver bromide fine grains. This process has to be considered separately from the conversion reaction. In a recrystallization reaction, a driving force for the reaction is the increase in entropy, which is an entirely different reaction from Ostwald ripening. This is described in, for example, H. C. Yutzy, "Journal of American Chemical Society", 59, pp. 916 (1937). It is surprising that while the two are entirely different types of reactions, a vicinity of an apex of a host grain is selected as a site in which a new phase rich in silver bromide is formed with either reaction.

(3) In order to more effectively achieve the purpose of obtaining a high sensitivity by concentrating a latent image or a developing nucleus, preferably used is a compound, a CR compound, for inhibiting or preventing the initiation of a halogen conversion. In general, a CR compound is a substance having a function to selectively adsorb on a specific crystal plane, to delay or entirely prevent the initiation of halogen conversion and recrystallization in comparison with the case in which the above compound does not adsorb. In the present invention, it is particularly the substance adsorbing primarily (selectively) on a (100) plane and acting to inhibit the initiation of conversion and recrystallization on the (100) plane.

Suitable CR compounds used in the present invention include, a cyanine dye, a merocyanine dye, mercaptoazoles, and a nucleic acid decomposition product such as a product formed in the course of decomposition of deoxyribonucleic acid and ribonucleic acid, adenine, guanine, uracil, cytosil, and thymine. The compounds represented by the following Formulae (I), (II) and (III) are preferred as CR compounds:

Formula (I)

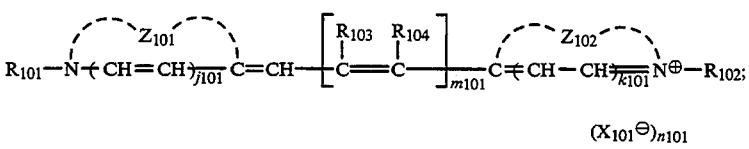

wherein $Z_{101}$ and $Z_{102}$ each represent a group of atoms necessary to form a heterocyclic nucleus.

Preferred as the heterocyclic nucleus is a 5 to 6-membered cyclic nucleus containing a nitrogen atom, a sulfur atom, an oxygen atom, a selenium atom, or a tellurium atom as a hetero atom. A condensed ring may further be bonded to these rings and a substituent may further be bonded thereto.

Specific examples of the above heterocyclic nucleus include, a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, an imidazole nucleus, benzimidazole nucleus, a naphthoimidazole nucleus, a 4-quinoline nucleus, a pyrroline nucleus, a pyridine nucleus, a tetrazole nucleus, an indolenine nucleus, a benzindolenine nucleus, an indole nucleus, a tellurazole nucleus, a benzotellurazole nucleus, and a naphthotellurazole nucleus.

$R_{101}$ and $R_{102}$ each represent an alkyl group, an alkenyl group, an alkynyl group, or an aralkyl group. Those groups and the following groups may include substituents. For example, suitable alkyl groups include unsubstituted and substituted alkyl groups. Also, the groups may be either linear, branched or cyclic. The alkyl group preferably has 1 to 8 carbon atoms.

Specific examples of substituents for substituted alkyl groups, include a halogen atom such as a chlorine, bromine or fluorine, a cyano group, an alkoxy group, a substituted or unsubstituted amino group, a carboxylic acid group, a sulfonic acid group, or a hydroxy group. They may be substituted singly or in combination.

A vinylmethyl group is an example of a suitable alkenyl group.

A benzyl group and a phenethyl group are specific examples of an aralkyl group.

$m_{101}$ represents an integer of 0, 1, 2 or 3. When $m_{101}$ represents 1, $R_{103}$ preferably represents a hydrogen atom, a lower alkyl group, an aralkyl group, or an aryl group.

Specific examples of an aryl group include a substituted or unsubstituted phenyl group.

$R_{104}$ preferably represents a hydrogen atom. When $m_{101}$ represents 2 or 3, $R_{103}$ preferably represents a hydrogen atom and $R_{104}$ can represent a hydrogen atom, as well as a lower alkyl group, and an aralkyl group, and can also be combined with $R_{102}$ to form a 5 to 6-membered ring. Further, when $m_{101}$ represents 2 or 3 and $R_{104}$represents a hydrogen atom, $R_{103}$'s may be combined with each other to form a hydrocarbon ring or a heterocyclic ring. Such rings are preferably 5 or 6-membered rings. $j_{101}$ and $k_{101}$ each represent 0 and 1; $X_{101}$ represents an acid anion; and $n_{101}$ represents 0 or 1.

Formula (II)

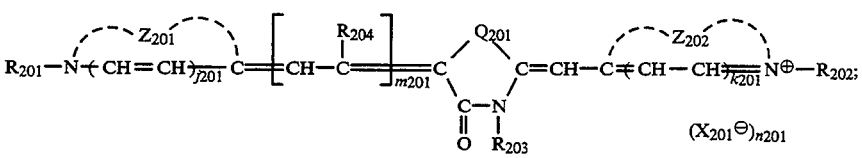

In formula (II), $Z_{201}$ and $Z_{202}$ are synonymous with $Z_{101}$ or $Z_{102}$. $R_{201}$ and $R_{202}$ are synonymous with $R_{101}$ or $R_{102}$. $R_{203}$ represents an alkyl group, an alkenyl group, an alkynyl group, or an aryl group such as a substituted or unsubstituted phenyl group. m201 represents 0, 1, or 2. $R_{204}$ not only represents a hydrogen atom, a lower alkyl group, or an aryl group, but also, $R_{204}$'s may be combined with each other to form a hydrocarbon ring or a heterocyclic ring when m201 represents 2. Such rings are preferably 5 or 6-membered rings.

$Q_{201}$ represents a sulfur atom, an oxygen atom, a selenium atom, or $=N-R_{205}$, where $R_{205}$ is synonymous with $R_{203}$. $j_{201}$, $k_{201}$, $X^-_{201}$ and $n_{201}$ are synonymous with $j_{101}$, $k_{101}$, $X^-_{101}$ and $n_{101}$, respectively.

Formula (III)

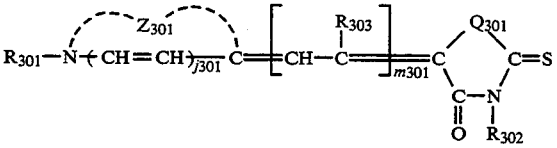

In formula (III ), $Z_{301}$ represents a group of atoms necessary to form a heterocyclic ring. Suitable examples of the above heterocyclic ring include the rings defined for $Z_{101}$ and $Z_{102}$ as well as a thiazolidine nucleus, a thiazoline nucleus, a benzothiazoline nucleus, a naphthothiazoline nucleus, a selenazolidine nucleus, a selenazoline nucleus, a benzoselenazoline nucleus, a naphthoselenazoline nucleus, a benzoxazoline nucleus, a naphthoxazoline nucleus, a dihydropyridine nucleus, a dihydroquinoline nucleus, a benzimidazoline nucleus, and a naphthoimidazoline nucleus. $Q_{301}$ is synonymous with $Q_{201}$. $R_{301}$ is synonymous with $R_{101}$ or $R_{102}$, and $R_{302}$ is synonymous with $R_{203}$. $m_{301}$ is synonymous with $m_{201}$. $R_{303}$ is synonymous with $R_{204}$, and when $m_{301}$ represents 2 or 3, $R_{303}$'s may be combined with each other to form a hydrocarbon ring or a heterocyclic ring. $j_{301}$ is synonymous with $j_{101}$.

The CR compound not only increases selectivity for an initial site in which a new phase richer in silver bromide than the host grains can be formed, but also prevents a reaction by which the above new, initially formed phase grows to a uniform and new layer covering the whole surface of the host grain by repeating a recrystallization on the host grain, and forms and maintains "a new phase richer in silver bromide" which is limited to the vicinity of an apex of the host grain and grows epitaxially.

The method in which the high silver bromide fine grains and host grains are mixed for ripening has an advantage in that uniformity of the reaction is high, and the reaction is easy to control. Also, this method is preferable since the silver bromide content of a new phase can be controlled over a wide range according to conditions such as silver bromide content and grain size of the high silver bromide fine grains used for mixing and ripening, and pAg of a recrystallization reaction.

The silver halide grains formed by this method have a new phase richer in silver bromide than the host grains, which grows epitaxially in the vicinity of an apex of a host grain containing 95 mole % or more of silver chloride, and have a loose transition region of a halogen composition which exists between the new phase and the host grain in some cases.

Such a grain structure can be observed by various analytical methods. First, the observation of the grains with an electron microscope shows that a new phase is conjugated in a vicinity of an apex of the grain. Further, the compositions of the host grain and new phase can be measured with an X-ray diffraction method.

An average halogen composition on the surface of the grain can be measured by an XPS (X-ray photoelectron spectroscopy) method with, for example, an ESCA 750 type electroscope manufactured by Shimadzu-du Pont Co., Ltd. To be specific, this method is described in "Surface Analysis" written by Someno et al, published by Kohdansha Co., Ltd. (1977).

The knowledge of the halogen compositions of the host grain and new phase provided by the X-ray diffraction method, and with the knowledge of an average halogen composition on the surface of the grain by XPS-method, make it possible to roughly estimate what percentage the new phase shares in the whole surface.

Further, the site where the new phase richer in silver bromide than the host grain is present can be identified and the proportion it shares in a vicinity of an apex of the grain can be measured by an EDX (energy dispersive X-ray analysis) with an EDX spectrometer equipped on a transmitting-type electron microscope, as well as the above method by the observation with an electron microscope. This method is described in "Electron Ray Microanalysis" written by Soejima, published by Nikkan Kogyo News Paper (1987).

The new phase according to the present invention is localized preferably in a vicinity of an apex of the host grain. An average halogen composition on the surface thereof comprises preferably silver bromide of 15 mol % or less, more preferably 10 mol % or less. The increase in a silver bromide content on the surface means a reduction of a localizing degree of the new phase in the vicinity of the apex, and results in the lowering of sensitivity at the same time.

It has been observed with an electron microscope that the new phase formed according the preparing method preferred in the present invention is in the form in which it is epitaxially conjugated and grown on a corner of the host grain.

A preferred grain size of the high silver bromide fine grain emulsion used in the present invention is variable depending on grain size and the halogen composition of the host grain, but is usually 0.3 μm or less, more preferably 0.1 μm or less.

It is required that the high silver bromide fine grain emulsion has a higher silver bromide content in the halogen composition thereof than that of the host grain. The bromide concentration thereof is preferably 50 mol % or more, more preferably 70 mol % or more.

The high silver bromide fine grain emulsion can contain silver iodide according to necessity. Further, it can contain the ions or compounds of heavy metals such as iridium, rhodium, platinum, and iron.

The whole amount to be supplied of bromine and/or a bromine ion, which is represented by the addition of the high silver bromide fine grain emulsion, is preferably in the range of 0.1 to 5 mole %, more preferably 0.1 to 1.5 mol % in terms of a silver amount based on the amount of silver halide contained in the host grain. An addition, temperature can be arbitrarily selected in the range of 30° to 80° C.

The formation of the silver bromide rich phase by supplying the bromine and/or bromine ion is preferably carried out two or three times. Further, the supply of the bromine and/or bromine ion at the plural times is carried out after the formation of the silver bromide rich phase is 80% or more complete, preferably 80 to 90% complete in the preceding stage.

In the silver bromochloride emulsion prepared according to the present invention, since a latent image or a developing center is centralized, a high sensitivity is achieved, stability is markedly improved, and fog is controlled without deteriorating rapid developing performance to obtain an excellent stability. Also, an emulsion with a harder gradation can surprisingly be obtained. Further, it has the advantages that pressure desensitization is small and fog in unexposed portions is also small.

The CR compounds used in the present invention can be selected from the sensitizing dyes. In particular, the CR compounds useful for a (100) plane can be selected from the compounds represented by the above Formulae (I), (II) and (III). They can function as a sensitizing dye and is accordingly useful for increasing spectral sensitivity. In particular, a partial recrystallization on the surface contributes to further stabilization of spectral sensitivity.

In order to further increase sensitivity and stability, they may be combined with other sensitizing dyes, or can be used in combination with a supersensitizing agent.

There may be contained in the light-sensitive material according to the present invention, for example, aminostilbene compounds substituted with a nitrogen-containing heterocyclic group such as those compounds represented by Formula (I), described in JP-A-62-174738, in particular, the specific compounds (I-1) to (I-17), and the compounds described in U.S. Pat. Nos. 2,933,390 and 3,635,721, the condensation products of aromatic organic acids and formaldehyde such as those compounds described in U.S. Pat. No. 3,743,510, cadmium salts, and azaindene compounds. Particularly useful are the combinations described in U.S. Pat. Nos. 3,615,613, 3,615,641, 3,617,295, and 3,635,721.

Specific examples of CR compounds useful in the invention represented by Formulae (I), (II) and (III) are set forth below, but the invention is not limited to their use.

CR-1

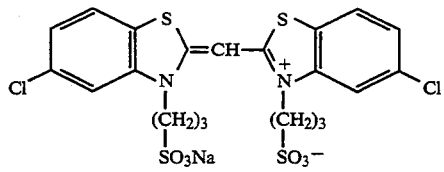

CR-2

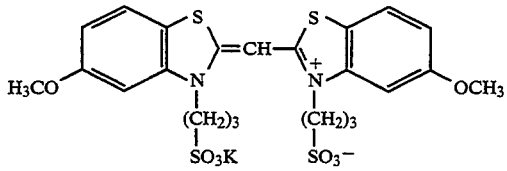

CR-3

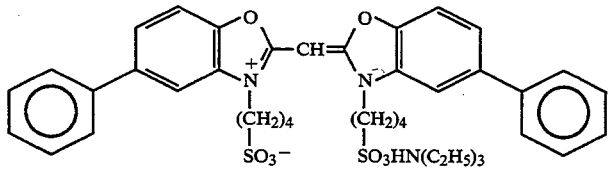

-continued
CR-4
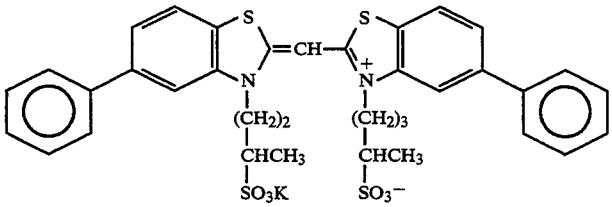
CR-5
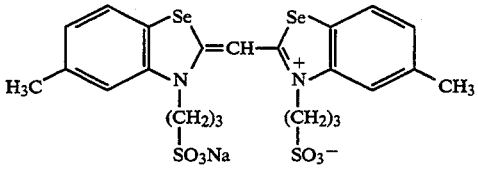
CR-6
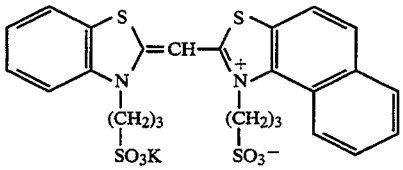
CR-7
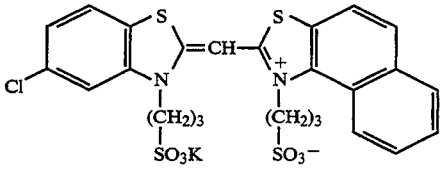
CR-8
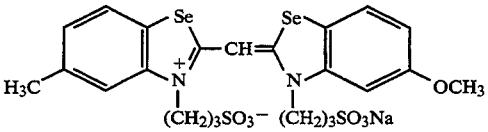
CR-9
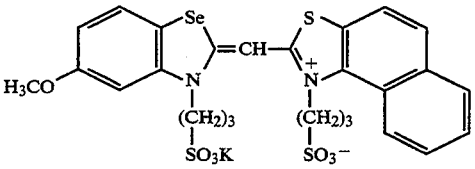
CR-10
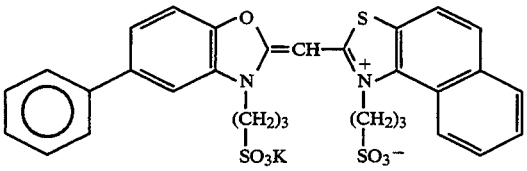
CR-11
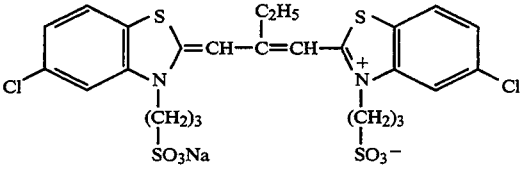

-continued
CR-12
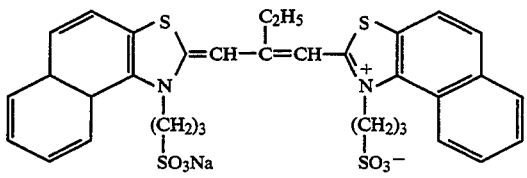
CR-13
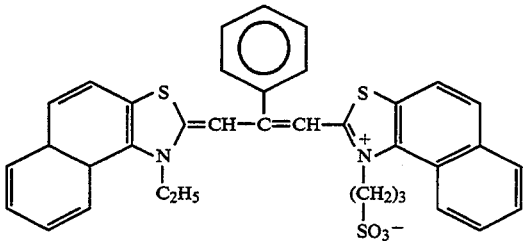
CR-14
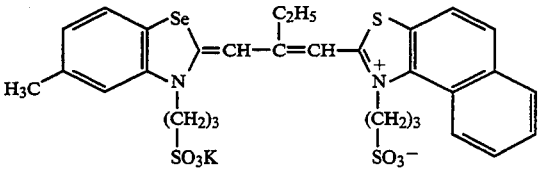
CR-15
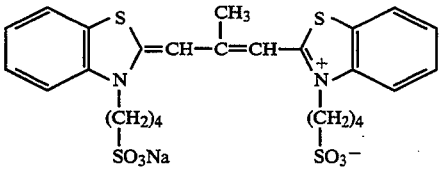
CR-16
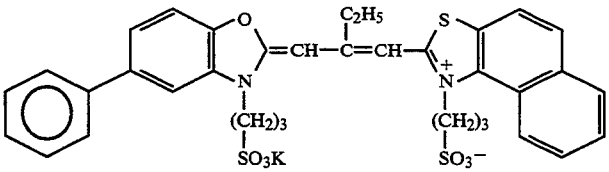
CR-17
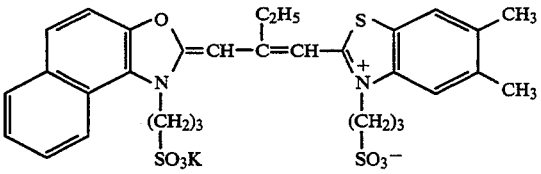
CR-18
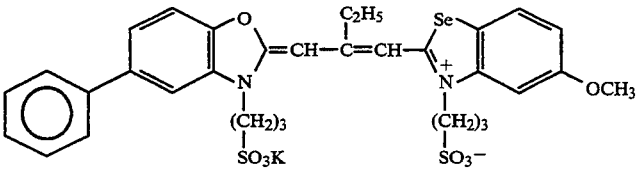
CR-19
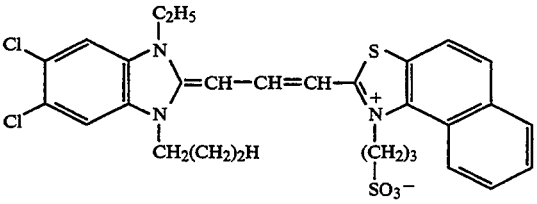

-continued
CR-20
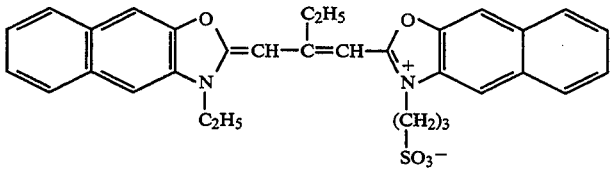
CR-21
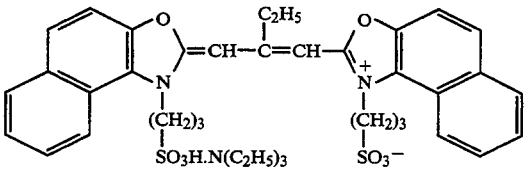
CR-22
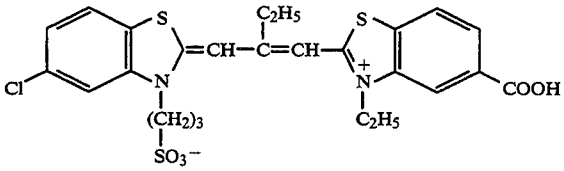
CR-23
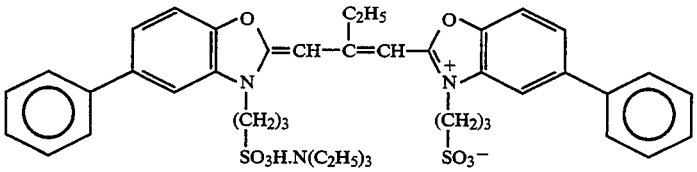
CR-24
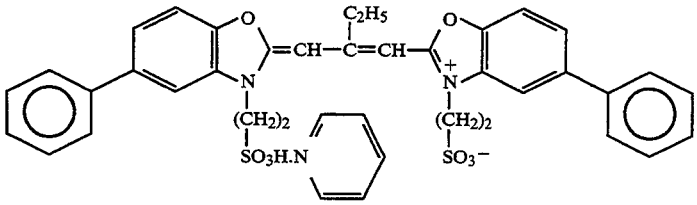
CR-25
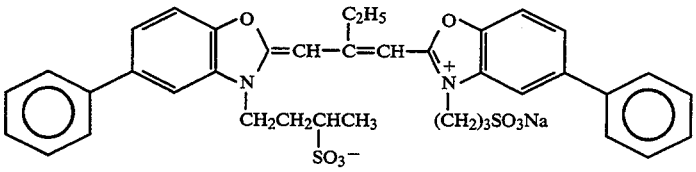
CR-26
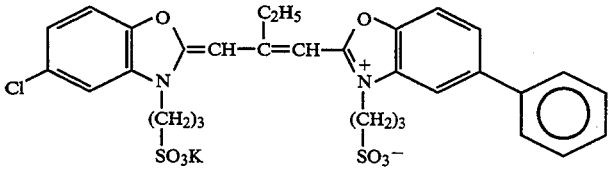
CR-27
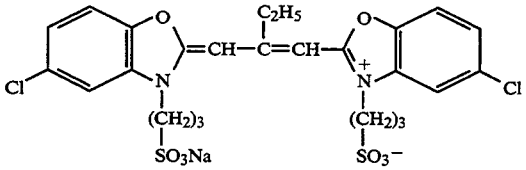

-continued
CR-28
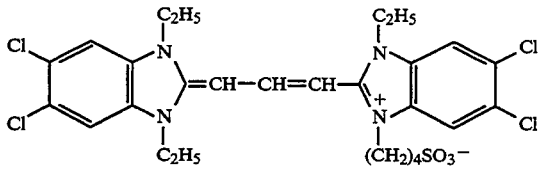
CR-29
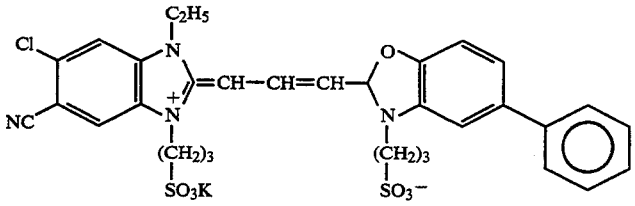
CR-30
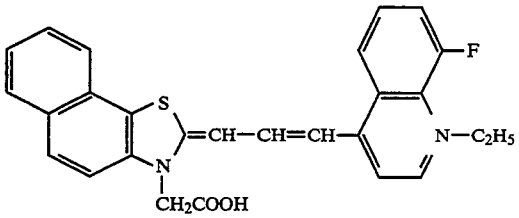
CR-31
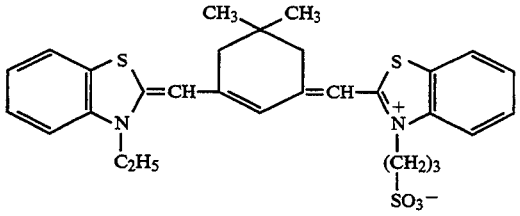
CR-32
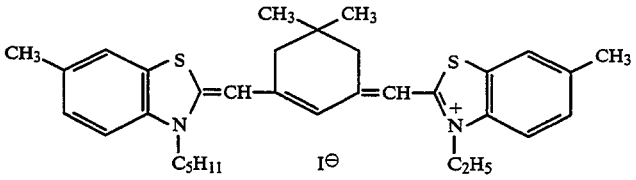
CR-33
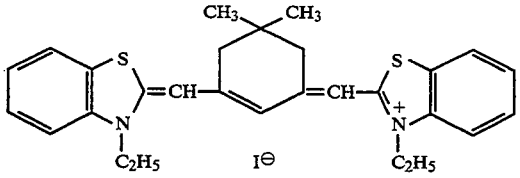
CR-34
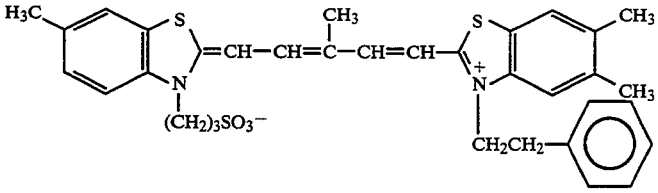
CR-35
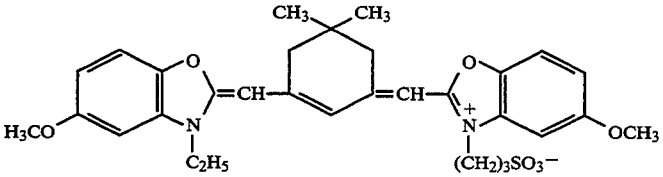

-continued
CR-36
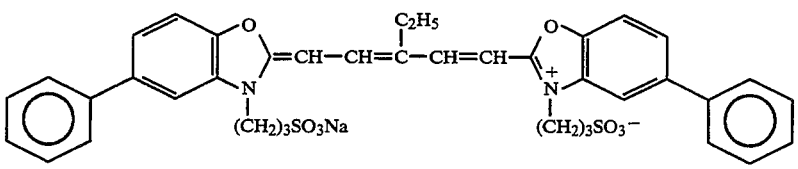
CR-37
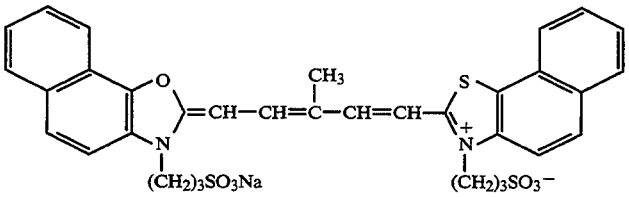
CR-38
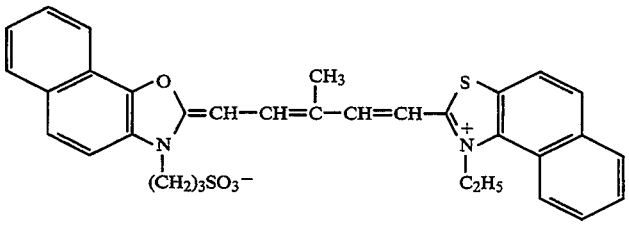
CR-39
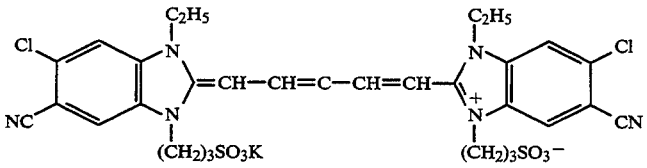
CR-40
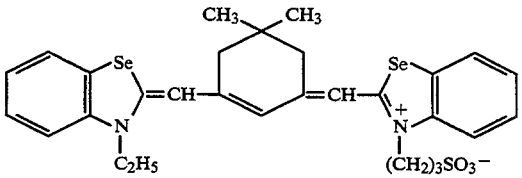
CR-41
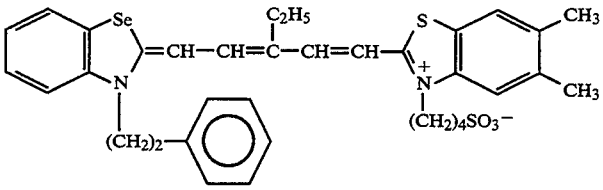
CR-42
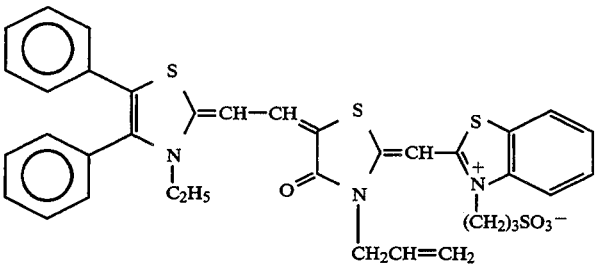

-continued
CR-43
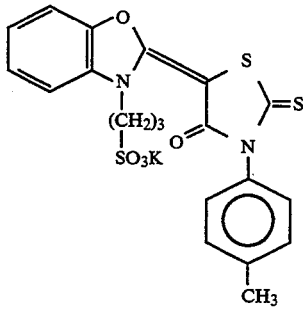
CR-44
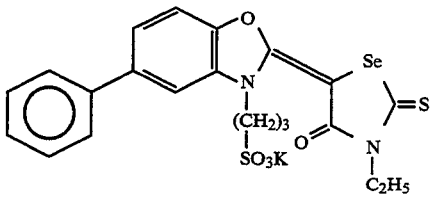
CR-45
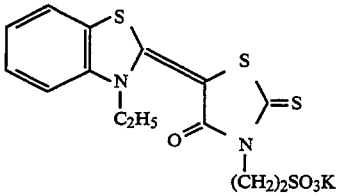
CR-46
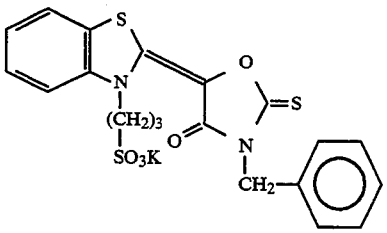
CR-47
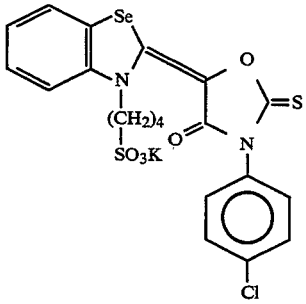
CR-48
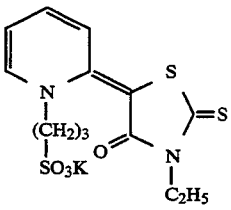

-continued
CR-49
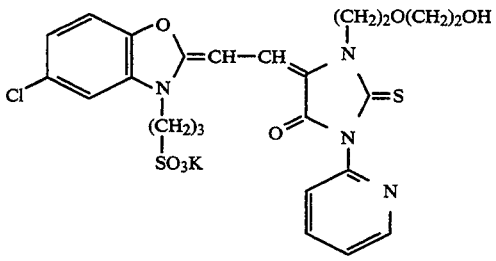
CR-50
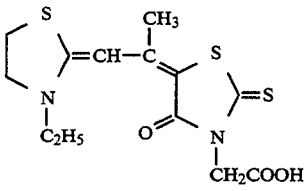
CR-51
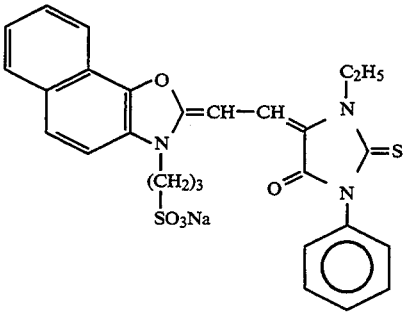
CR-52
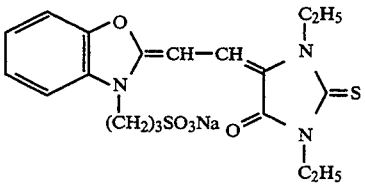
CR-53
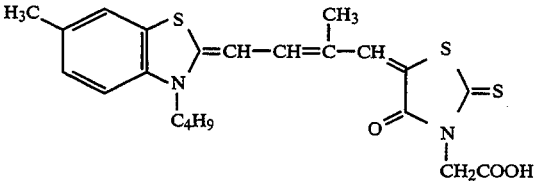
CR-54
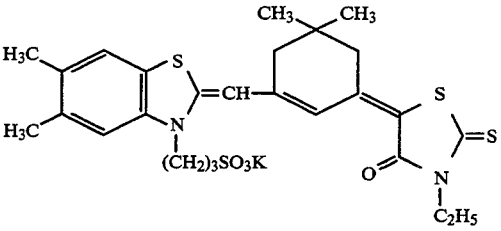

-continued

CR-55

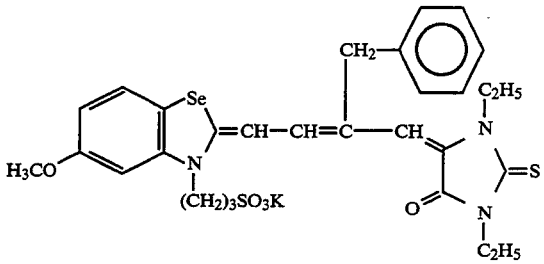

Of the silver halide emulsions used for the color photographic light-sensitive material according to the present invention, the emulsions prepared by the method according to the present invention are incorporated into at least one silver halide emulsion layer.

There can be used as the other silver halides used for the color light-sensitive material according to the present invention, silver chloride, sliver bromide, silver bromochloroiodide, silver bromochloride and silver bromoiodide. In particular, for the purpose of a rapid processing, preferably used is a silver bromochloride or silver chloride containing substantially no silver iodide and having a silver chloride content of 90 mol % or more, more preferably 95 mol % or more, and particularly preferably 98 mol % or more. Of these embodiments, the most preferred is the embodiment where three kinds of the silver halide emulsion layers with different color hues contain the silver halide emulsions prepared by the method according to the present invention.

For the purpose of improving sharpness of an image, there may be preferably incorporated into a hydrophilic colloid layer of the light-sensitive material according to the present invention, dyes, such as oxonol type dyes, capable of being decolored by processing so that an optical reflection density of the light-sensitive material in 680 nm becomes 0.70 or more, as described at pages 27 to 76 of European Patent EP 0 337 490A2; and into an anti-water resin layer of a support, titanium oxide which is subjected to a surface treatment with di- to tetrahydric alcohols (for example, trimethylolethane) in a proportion of 12% by weight or more (more preferably 14% by weight or more).

The photographic additives which can be used in the present invention, such as cyan, magenta and yellow couplers, are preferably used by dissolving them in a high boiling organic solvent. The high boiling organic solvent can be used so long as it is a compound which has a melting point of 100° C. or lower and a boiling point of 140° C. or higher and is immiscible with water, and is a good solvent for a particular coupler. The melting point of the high boiling organic solvent is preferably 80° C. or lower. The boiling point of the high boiling organic solvent is preferably 160° C. or higher, more preferably 170° C. or higher.

Details of such high boiling organic solvents are set forth in the right lower column at page 137 to the right upper column at page 144, of JP-A-62-215272.

A cyan, magenta or yellow coupler can be impregnated in a loadable latex polymer (for example, U.S. Pat. No. 4,203,716) in the presence or absence of a high boiling organic solvent, or can be dissolved together with a water insoluble and organic solvent soluble polymer to emulsify and disperse in a hydrophilic colloid aqueous solution.

Preferably used are the homopolymers or copolymers described in the seventh column to fifteenth column of U.S. Pat. No. 4,857,449, and at pages 12 to 30 of International Patent Publication 088/00723. More preferably used are the methacrylate type or acrylamide-type polymers. Particularly preferred are the acrylamide-type polymers from the viewpoint of stabilizing a dye image.

Also, in the light-sensitive material according to the present invention, the color image preservability-improving compounds described in European Patent 0 277 589A2, are preferably used together with couplers. In particular, they are preferably used in combination with a pyrazoloazole coupler.

Preferably used for reducing adverse side effects such as the generation of stain due to the reaction of a color developing agent or an oxidation product thereof remaining in a layer during storage after processing with a coupler, are used alone or in combination therewith the compounds (F) which form a chemically inactive and substantially colorless compound by a reaction with an aromatic amine-type developing agent remaining after processing of color development, and/or the compounds (G) which are chemically combined with the oxidation product of an aromatic amine-type developing agent remaining after color development processing, to form a chemically inactive and substantially colorless compound.

Further, anti-mold agents such as those described in JP-A-63-271247, are preferably added to the light-sensitive material according to the present invention. This can prevent various molds and bacteria which grow in a hydrophilic colloid layer, from deteriorating an image.

As a support for the light-sensitive material according to the present invention there may be used, for display, a white color polyester type support or a support in which a layer containing a white pigment is provided on a support side having a silver halide emulsion layer. An anti-halation layer is preferably provided on a support side on which a silver halide emulsion layer is coated, or the backside thereof in order to further improve sharpness. In particular, a transmission density of a support is controlled in the range of 0.35 to 0.8 so that a display can be admired with either a reflected light or a transmitted light.

The light-sensitive material according to the present invention may be exposed with either a visible ray or an infrared ray. The exposing manner may be either a low illuminance exposure or a high illuminance exposure for a short time. Particularly in the latter case, preferred is a laser scanning exposing method in which an exposing time per a picture element is shorter than $10^{-4}$ second.

In exposure, a band stop filter such as that described in U.S. Pat. No. 4,880,726 is preferably used, whereby a light mixture is removed to notably improve color contamination.

An exposed light-sensitive material can be subjected to a conventional development processing. In the case of a color light-sensitive material, it is preferably subjected to a bleach-fixing treatment after a color development for the purpose of a rapid processing. In particular, where the high silver chloride emulsion is used, the pH of a bleach-fixing solution is preferably about 6.5 or less, more preferably 6 or less for the purpose of accelerating desilvering.

Those described in the following patent publications, particularly European Patent Publication EP 0,355,660A2 (JP-A-2-139544), are preferably used as the silver halide emulsions and other materials (the additives) applied to the light-sensitive material according to the present invention, and the processing methods and additives for processing, which are applied for processing the light-sensitive material:

TABLES 1 to 5

| Photographic element | JP-A-62-215272 | JP-A-2-33144 | EP 0355660 |
|---|---|---|---|
| Silver halide emulsion | pp. 10, right upper column, line 6 to pp. 12, left lower column, line 5, and pp. 12, right lower column, line 4 from bottom to pp. 13, left upper column, line 17 | pp. 28, right upper column, line 16 to pp. 29, right lower column, line 11, and pp. 30, lines 2 to 5 | pp. 45, line 53 to pp. 47, line 3, and pp. 47, lines 20 to 22 |
| Silver halide solvent | pp. 12, left lower column, lines 6 to 14, and pp. 13, left upper column, line 3 from bottom to pp. 18, left lower column, last line | — | — |
| Chemical sensitizer | pp. 12, left lower column, line 3 from bottom to right lower column, line 5 from bottom, and pp. 18, right lower column, line 1 to pp. 22, right upper column, line 9 from bottom | pp. 29, right lower column, line 12 to last line | pp. 47, lines 4 to 9 |
| Spectral sensitizer (spectral sensitizing method) | pp. 22, right upper column, line 8 from bottom to pp. 38, last line | pp. 30, left upper column, lines 1 to 13 | pp. 47, lines 10 to 15 |
| Emulsion stabilizer | pp. 39, left upper column, line 1 to pp. 72, right upper column, last line | pp. 30, left upper column, line 14 to right upper column, line 1 | pp. 47, lines 16 to 19 |
| Development accelerator | pp. 72, left lower column, line 1 to pp. 91, right upper column, line 3 | — | — |
| Color coupler (cyan, magenta and cyan couplers) | pp. 91, right upper column, line 4 to pp. 121, left upper column, line 6 | pp. 3, right upper column, line 14 to pp. 18, left upper column, last line, and pp. 30, right upper column, line 6 to pp. 35 right lower column, line 11 | pp. 4, lines 15 to 27, pp. 5, line 30 to pp. 28, last line, pp. 29, lines 29 to 31 and pp. 47, line 23 to pp. 63, line 50 |
| Color forming accelerator | pp. 121, left upper column, line 7 to pp. 125, right upper column, line 1 | — | — |
| UV absorber | pp. 125, right upper column, line 2 to pp. 127, left lower column, last line | pp. 37, right lower column, line 14 to pp. 38, left upper column,line 11 | pp. 65, lines 22 to 31 |
| Anti-fading agent (an image stabilizer) | pp. 127, right lower column, line 1 to pp. 137, left lower column, line 8 | pp. 36, right upper column, line 12 to pp. 37, left upper column, line 19 | pp. 4, line 30 to pp. 5, line 23, pp. 29, line 1 to pp. 45, line 25, pp. 45, lines 33 to 40, and pp. 65, lines 2 to 21 |
| High boiling and/or low boiling organic solvent | pp. 137, left lower column, line 9 to pp. 144, right upper, last line | pp. 35, right lower column, line 14 to pp. 36, left upper, line 4 from bottom | pp. 64, lines 1 to 51 |
| Method for dispersing photographic additives | pp. 144, left lower column, line 1 to pp. 146, right upper column, line 7 | pp. 27, right lower column, line 10 to pp. 28, left upper, last line, and pp. 35, right lower column, line 12 to pp. 36, right upper column, line 7 | pp. 63, line 51 to pp. 64, line 56 |
| Hardener | pp. 146, right upper column, line 8 to pp. 155, left lower column, line 4 | — | — |
| Precursor of a developing agent | pp. 155, left lower column, line 5 to right lower column, line 2 | — | — |
| Development inhibitor-releasing | pp. 155, right lower column, lines 3 to 9 | — | — |

TABLES 1 to 5-continued

| Photographic element | JP-A-62-215272 | JP-A-2-33144 | EP 0355660 |
|---|---|---|---|
| compound | | | |
| Support | pp. 155, right lower column, line 19 to pp. 156, left upper column, line 14 | pp. 38, right upper column, line 18 to pp. 39, left upper column, line 3 | pp. 66, line 29 to pp. 67 line 13 |
| Light-sensitive layer structure | pp. 156, left upper column, line 15 to right lower column, line 14 | pp. 28, right upper column, lines 1 to 15 | pp. 45, lines 41 to 52 |
| Dye | pp. 156, right lower column, line 15 to pp. 184, right lower column, last line | pp. 38, left upper column, line 12 to right upper column, line 7 | pp. 66, lines 18 to 22 |
| Anti-color mixing agent | pp. 185, left upper column, line 1 to pp. 188, right lower column, line 3 | pp. 36, right upper column, lines 8 to 11 | pp. 64, line 57 to pp. 65 line 1 |
| Gradation controller | pp. 188, right lower column, lines 4 to 8 | — | — |
| Anti-stain agent | pp. 188, right lower column, line 9 to pp. 193, right lower column, line 10 | pp. 37, left upper column, last line to right lower column, line 13 | pp. 65, line 32 to pp. 66, line 17 |
| Surface active agent | pp. 201, left lower column, line 1 to pp. 210, right upper column, last line | pp. 18, right upper column, line 1 to pp. 24, right lower column, last line, and pp. 27, left lower column, line 10 from bottom to right lower column, line 9 | — |
| Fluorinated compound (anti-electrification agent, coating aid, lubricant and anti-adhesion agent) | pp. 210, left lower column, line 1 to pp. 222, left lower column, line 5 | pp. 25, left upper column, line 1 to pp. 27, right lower column, line 9 | — |
| Binder (hydrophilic colloid) | pp. 222, left lower column, line 6 to pp. 225, left upper column, last line | pp. 38, right upper column, lines 8 to 18 | pp. 66, lines 23 to 28 |
| Thickener | pp. 225, right upper column, line 1 to pp. 227, right upper column, line 2 | — | — |
| Anti-electrification agent | pp. 227, right upper column, line 3 to pp. 230, left upper column, line 1 | — | — |
| Polymer latex | pp. 230, left upper column, line 2 to pp. 239, last line | — | — |
| Matting agent | pp. 240, left upper column, line 1 to right upper column, last line | — | — |
| Photographic-processing method (processing steps and additives) | pp. 3, right upper column, line 7 to pp. 10, right upper column, line 5 | pp. 39, left upper column, line 4 to pp. 42, left upper column, last line | pp. 67, line 14 to pp. 69, line 28 |

Remarks:
1. There is included in the cited items of JP-A-62-215272, the content amended according to the Amendment of March 16, 1988.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

Preferably used in the present invention as a cyan coupler are, in addition to the diphenylimidazole-type cyan couplers described in JP-A-2-33144, the 3-hyroxypyridine-type cyan couplers described in European Patent EP 0,333,185A2. Of those, particularly preferred are Coupler (42), in which tetraequivalence is converted to diequivalence by giving a chlorine-splitting group, Coupler (6) and Coupler (9). Also preferred are the cyclic active methylene-type cyan couplers described in JP-A-64-32260. Of those, particularly preferred are Couplers 3, 8 and 34.

As for a method for processing the color light-sensitive material in which a high silver chloride emulsion having a silver chloride content of 90 mol % or more, preferably used is the method described in a left upper column of page 27 to a right upper column of page 34 of JP-A-2-207250.

In the interest of brevity and conciseness, the content of the aforementioned numerous patents and articles are hereby incorporated by reference.

The present invention will be explained further below with reference to the following examples, but the present invention should not be construed as being limited to the specific examples.

EXAMPLE 1

Preparation of Emulsion A

Sodium chloride 3.3 g was added to a 3% aqueous solution of lime-treated gelatin and further, N,N'-dimethylimidazolidine-2-thione (a 1% aqueous solution) was added. An aqueous solution containing silver nitrate 0.5 mole and an aqueous solution containing sodium chloride 0.5 mole were added and mixed with this solution at 66° C. while vigorously stirring. Subsequently, an aqueous solution containing silver nitrate 0.45 mole and an aqueous solution containing sodium chloride 0.45 mole were added and mixed at 66° C. while vigorously stirring. Afterwards, a copolymer of isobutene/maleic acid 1-sodium salt was added at 40° C. to carry out washing by settling for desalting. Further, lime-treated gelatin 90.0 g was added, and the pH and pAg of the emulsion were adjusted to 6.2 and 6.5, respectively. There was used as a bromine supplying process, the method where a silver bromide fine grain emulsion having a grain size of 0.05 μm was added to the emulsion at 50° C. in terms of a silver amount of 0.006 mole, whereby a silver bromide rich phase was formed on the surface of the silver halide host grains, and then a sulfur sensitizer (triethyl thiourea) $1\times10^{-5}$ mole/mole of Ag and nucleic acid 0.2 g/mole of Ag to provide an optimum chemical sensitization at 50° C., wherein potassium hexachloroiridate (IV) 0.8 mg per 0.005 mole of the silver bromide fine grains was incorporated in advance into the silver bromide fine grains during the grain formation.

The emulsion (A) thus obtained was subjected to the measurement of a grain form, a grain size and a grain size distribution with an electron microscope. The silver halide grains were cubic and had an average grain size of 0.50 μm and a fluctuation coefficient of 0.08. The average grain size was expressed by an average value of the diameters of the circles having the same areas as the projected areas of the grains. The grain size distribution was represented by the value obtained by dividing a standard deviation of a grain size with an average grain size.

Preparation of Emulsion B

The process for supplying bromine to the above emulsion (A) was changed. That is, there was used the method in which a silver bromide fine grain emulsion having a grain size of 0.05 μm was added at 50° C. in terms of a silver amount of 0.003 mole to provide a ripening for 4 minutes to thereby form a silver bromide rich phase in a vicinity of an apex of the silver chloride host grain, and then the same silver bromide fine grain emulsion was added once again in terms of a silver amount of 0.003 mole at the same condition.

Preparation of Emulsion C

The process for supplying bromine to the above emulsion (A) was changed. That is, there was used the method in which a silver bromochloride fine grain emulsion having a grain size of 0.05 μm and a silver bromide content of 60 mol % was added at 50° C. in terms of a silver amount of 0.0045 mole to provide a ripening for 4 minutes to thereby form a silver bromide rich phase in a vicinity of an apex of the silver chloride host grain, and then the silver bromide fine grain emulsion having a grain size of 0.05 μm and a silver bromide content of 60 mol % was added once again in terms of a silver amount of 0.0045 mole to provide a ripening at 50° C. for 12 minutes.

Preparation of Emulsion D

The process for supplying bromine to the above emulsion (A) was changed. That is, there was used the method in which a silver bromide fine grain emulsion having a grain size of 0.05 μm was added in terms of a silver amount of 0.005 mole to provide a ripening for 4 minutes to thereby form a silver bromide rich phase in a vicinity of an apex of the silver chloride host grain, and then the silver bromochloride fine grain emulsion having a grain size of 0.05 μm and a silver bromide content of 60 mol % was added at 50° C. in terms of a silver amount of 0.0045 mole to provide a ripening for 12 minutes.

Preparation of Emulsion E

The process for supplying bromine to the above emulsion (A) was changed. That is, there was used the method in which a silver bromochloride fine grain emulsion having a grain size of 0.05 μm and a silver bromide content of 60 mol % was added at 50° C. in terms of a silver amount of 0.009 mole to provide a ripening for 4 minutes to thereby form a silver bromide rich phase in a vicinity of an apex of the silver chloride host grain, and then the silver bromide fine grain emulsion having a grain size of 0.05 μm was added at 50° C. in terms of a silver amount of 0.0025 mole to provide a ripening for 12 minutes.

Preparation of Emulsion F

The process for supplying bromine to the above emulsion (A) was changed. That is, there was used the method in which a silver bromochloride fine grain emulsion having a grain size of 0.05 μm and a silver bromide content of 60 mol % was added at 50° C. in terms of a silver amount of 0.0045 mole to provide a ripening for 4 minutes to thereby form a silver bromide rich phase in a vicinity of an apex of the silver chloride host grain, and then a silver bromochloride fine grain emulsion having a grain size of 0.05 μm and a silver bromide content of 80 mol % was added at 50° C. in terms of a silver amount of 0.0045 mole to provide a ripening for 4 minutes to thereby form a new silver bromide rich phase in a vicinity of an apex of the silver chloride host grain; further, a silver bromide fine grain emulsion having an average grain size of 0.05 μm was added at 50° C. in terms of a silver amount of 0.0025 mole to provide a ripening for 12 minutes.

Preparation of Emulsion G

The process for supplying bromine to the above emulsion (A) was changed. That is, there was used the method in which an aqueous solution (IV) prepared as follows was added to provide a ripening for 4 minutes to thereby form a silver bromide rich phase in a vicinity of an apex of the silver chloride host grain, and then the silver bromide fine grain emulsion having a grain size of 0.05 μm was added at 50° C. in terms of a silver amount of 0.003 mole to provide a ripening for 4 minutes.

Aqueous solution (IV): an aqueous solution 5.7 ml containing 0.5 mole/liter of above S-3.

Preparation of Emulsion H

The process for supplying bromine to the above emulsion (A) was changed. That is, there was used the method in which an aqueous solution (V) prepared as follows was added to provide a ripening for 4 minutes to thereby form a silver bromide rich phase in a vicinity of an apex of the silver chloride host grain, and then the silver bromide fine grain emulsion having a grain size of 0.05 μm was added at 50° C. in terms of a silver amount of 0.003 mole to provide a ripening for 12 minutes.

Aqueous solution (V): an aqueous solution 5.7 ml containing 0.5 mole/liter of KBr.

Preparation of Emulsion I

The process for supplying bromine to the above emulsion (A) was changed. That is, there was used the method in which a silver bromide fine grain emulsion having a grain size of 0.05 μm was added at 50° C. in terms of a silver amount of 0.003 mole to provide a ripening for 4 minutes to thereby form a silver bromide rich phase in a vicinity of an apex of the silver chloride host grain, and then the above aqueous solution (V) was added at 50° C. to provide a ripening for 12 minutes.

Preparation of Emulsion J

Emulsion J was prepared in the same manner as Emulsion E except that above CR-32 ($1.5\times10^{-4}$ mole per mole of silver halide) was added prior to the process for supplying bromine.

Preparation of Emulsion K

Emulsion K was prepared in the same manner as Emulsion G except that CR-32 ($1.5\times10^{-4}$ mole per mole of silver halide) was added prior to the process for supplying bromine.

Preparation of Emulsion L

The process for supplying bromine to the above emulsion (A) was changed. That is, there was used the method in which a silver bromochloride fine grain emulsion having a grain size of 0.05 μm and a silver bromide content of 60 mol % was added at 50° C. in terms of a silver amount of 0.0045 mole to provide a ripening for 2 minutes to thereby form a silver bromide rich phase in a vicinity of an apex of the silver chloride host grain, and then the silver bromochloride fine grain emulsion having a grain size of 0.05 μm and a silver bromide content of 60 mol % was added at 50° C. in terms of a silver amount of 0.0045 mole to provide a ripening for 12 minutes.

Preparation of Emulsion M

The process for supplying bromine to the above emulsion (A) was changed. That is, there was used the method in which a silver bromochloride fine grain emulsion having a grain size of 0.05 μm and a silver bromide content of 60 mol % was added at 50° C. in terms of a silver amount of 0.0045 mole to provide a ripening for 4 minutes to thereby form a silver bromide rich phase in a vicinity of an apex of the silver chloride host grain, and then a silver bromochloride fine grain emulsion having a grain size of 0.05 μm and a silver bromide content of 80 mol % was added at 50° C. in terms of a silver amount of 0.0045 mole to provide a ripening for 2 minutes to thereby form a silver bromide rich phase on a grain surface; further, a silver bromide fine grain emulsion having a grain size of 0.05 μm was added at 50° C. in terms of a silver amount of 0.0025 mole to provide a ripening for 12 minutes.

Preparation of Emulsion N

The process for supplying bromine to the above emulsion (A) was changed. That is, there was used the method in which an aqueous solution (IV) prepared as above was added to provide a ripening for 2 minutes to thereby form a silver bromide rich phase in a vicinity of an apex of the silver chloride host grain, and then the silver bromide fine grain emulsion having a grain size of 0.05 μm was added at 50° C. in terms of a silver amount of 0.003 mole to provide a ripening for 12 minutes.

Bromine and/or a bromine ion were supplied to the emulsions thus prepared, and the respective emulsions were sampled immediately before the next supply of bromine and/or bromine ion, to measure an average halogen composition on a surface with an XPS method and the maximum AgBr content in a silver bromide rich phase with an X ray diffraction method. The results thereof are shown in Table 1.

TABLE 1

| | First stage | | | Second stage | | | Third stage | | |
|---|---|---|---|---|---|---|---|---|---|
| Emulsion | A | B | C | A | B | D | A | B | E |
| (A) | 12 | about 50 mol % | — | — | — | — | — | — | * |
| (B) | 7 | 50 | 0.12 | 13 | about 50 mol % | — | — | — | * |
| (C) | 6 | 30 | 0.17 | 12 | 45 | — | — | — | * |
| (D) | 11 | 45 | 0.15 | 14 | 50 | — | — | — | * |
| (E) | 10 | 35 | 0.18 | 13 | 50 | — | — | — | * |
| (F) | 6 | 30 | 0.12 | 10 | 35 | 0.18 | 13 | about 50 mol % | * |
| (G) | 8 | 40 | 0.13 | 13 | 45 | — | — | — | * |
| (H) | 6 | 35 | 0.11 | 12 | 45 | — | — | — | * |
| (I) | 7 | 40 | 0.14 | 14 | 50 | — | — | — | * |
| (J) | 5 | 35 | 0.18 | 13 | 50 | — | — | — | * |
| (K) | 4 | 40 | 0.13 | 13 | 45 | — | — | — | * |
| (L) | 5 | 25 | 0.22 | 12 | 45 | — | — | — | * |
| (M) | 6 | 30 | 0.12 | 8 | 30 | 0.23 | 12 | about 45 mol % | * |
| (N) | 5 | 30 | 0.25 | 12 | 45 | — | — | — | * |

A: average silver bromide content on the surface (mol %).
B: maximum silver bromide content in a silver bromide rich phase.
C: unreacted Br number immediately before supplying at the second stage/unreacted Br number immediately after supplying at the first stage.
D: unreacted Br number immediately before supplying at the third stage/unreacted Br number immediately after supplying at the second stage.
E: position at which a silver bromide rich phase is formed.
*: corner of a cube.

It was found from the values from the ratio of unreacted Br present immediately before supplying at the second stage to the unreacted Br present immediately after supplying at the first stage, that in Emulsions B to K and M, the formation of a silver bromide-localized phase formed by supplying bromine at the first stage was finished by 82 to 89% immediately before supplying bromine at the second stage. Meanwhile, in Emulsions L and N, it was finished by 78% and 75%, respectively.

Next, ethyl acetate 25.0 ml and a solvent (Solvent 6) 4.2 g were added to a cyan coupler (ExC-1) 9.6 g, a dye image stabilizer (Cpd-2) 0.6 g, a dye image stabilizer (Cpd-6) 5.4 g, a dye image stabilizer (Cpd-7) 12 g, a dye image stabilizer (Cpd-8) 1.5 g, and a dye image stabilizer (Cpd-4) 0.4 g to dissolve them. That solution was added to a 10% gelatin aqueous solution 402 ml containing a 10% sodium dodecylbenzenesulfonate aqueous solution 20.0 ml for emulsifying and dispersing, whereby an emulsified dispersion A was prepared.

The particulars of the above additives are the same as those for the additives used in Example 2.

In total, 14 kinds of the samples were prepared as shown in Table 2. Polyethylene provided thereon with an emulsion layer and a protective layer contained titanium dioxide and a small amount of ultramarine. Sodium 1-oxy-3,5-dichloro-s-triazine was used as hardener for the respective layers.

TABLE 2

| Sample No. | Support | Red-sensitive emulsion layer: Emulsion* | Emulsified dispersion | | Protective layer |
|---|---|---|---|---|---|
| 101 (Comp.) | Support laminated on both sides with polyethylene | (A) | Emulsified dispersion A | | Gelatin coated amount: 1340 mg/m$^2$ |
| 102 (Inv.) | | (B) | Cyan coupler (ExCl) | 320 mg/m$^2$ | |
| 103 (Inv.) | | (C) | Dye image stabilizer (Cpd-2) | 30 mg/m$^2$ | |
| 104 (Inv.) | | (D) | Dye image stabilizer (Cpd-4) | 20 mg/m$^2$ | |
| 105 (Inv.) | | (E) | Dye image stabilizer (Cpd-6) | 18 mg/m$^2$ | |
| 106 (Inv.) | | (F) | Dye image stabilizer (Cpd-7) | 40 mg/m$^2$ | |
| 107 (Inv.) | | (G) | Dye image stabilizer (Cpd-8) | 5 mg/m$^2$ | |
| 108 (Inv.) | | (H) | Solvent (Solv-6) | 140 mg/m$^2$ | |
| 109 (Inv.) | | (I) | (Gelatin was added to the coating solution so that a coated amount of gelatin became 1340 mg/m$^2$) | | |
| 110 (Inv.) | | (J) | | | |
| 111 (Inv.) | | (K) | | | |
| 112 (Comp.) | | (L) | | | |
| 113 (Inv.) | | (M) | | | |
| 114 (Comp.) | | (N) | | | |

*Coated silver amount: 400 mg/m$^2$

The following tests were carried out in order to check the photographic properties of the coated samples.

First, the respective coated samples were subjected to a gradation exposure for a sensitometry via a green filter with a densitometer (an FWH type manufactured by Fuji Photo Film Co., Ltd.; a color temperature of a light source: 3200° K.), wherein the exposure was made so that an exposing amount became 250 CMS at an exposing time of 1/10 second.

Subsequently, the samples were subjected to the following color development processings.

| Processing step | Temperature | Time |
|---|---|---|
| Color developing | 35° C. | 45 seconds |
| Bleach/fixing | 35° C. | 45 seconds |
| Rinsing | 28 to 35° C. | 95 seconds |
| Color developing solution | | |
| Triethanolamine | | 8.12 g |
| N,N-diethylhydroxylamine | | 4.93 g |
| Fluorescent whitening agent (UVIT EX CK manufactured by Ciba Geigy Co., Ltd.) | | 2.80 g |
| 4-Amino-3-methyl-N-ethyl-N-[β-(methanesulfonamide)ethyl]-p-phenylenediamine sulfate | | 4.96 g |
| Sodium sulfite | | 0.13 g |
| Potassium carbonate | | 18.40 g |
| Potassium bicarbonate | | 4.85 g |
| EDTA.2Na.2$H_2O$ | | 2.20 g |
| Sodium chloride | | 1.36 g |
| Water was added to make the total quantity | | 1000 ml |
| pH | | 10.05 |
| Bleach-fixing solution | | |
| Ammonium thiosulfate (54 wt %) | | 103.0 ml |
| $NH_4$[EDTA.Fe] | | 54.10 mg |
| EDTA.2Na.2$H_2O$ | | 3.41 g |
| Sodium sulfite | | 16.71 g |
| Glacial acetic acid | | 8.61 g |
| Water was added to make the total quantity | | 1000 ml |
| pH | | 5.44 |

A color developing density of each sample after processing was measured to obtain a sensitivity and a gradation. The sensitivity is defined by the reciprocal of an exposure amount which gives a color developing density higher by 0.5 than a fog density, and was expressed by a value relative to that of Sample 101, which is set at 100.

The gradation is expressed as the difference of the logarithm of an exposure amount which gives a color developing density of 0.2 and the logarithm of an exposure amount which gives a color developing density of 0.5. The smaller the value, the harder gradation.

The results are summarized in Table 3.

TABLE 3

| Sample No. | Sensitivity | Gradation |
|---|---|---|
| 101 (Comp.) | 100 | 0.270 |
| 102 (Inv.) | 101 | 0.260 |
| 103 (Inv.) | 102 | 0.255 |
| 104 (Inv.) | 102 | 0.253 |
| 105 (Inv.) | 101 | 0.250 |
| 106 (Inv.) | 99 | 0.246 |
| 107 (Inv.) | 92 | 0.255 |
| 108 (Inv.) | 90 | 0.260 |
| 109 (Inv.) | 95 | 0.253 |
| 110 (Inv.) | 130 | 0.250 |
| 111 (Inv.) | 120 | 0.243 |
| 112 (Comp.) | 57 | 0.280 |
| 113 (Inv.) | 96 | 0.263 |
| 114 (Comp.) | 83 | 0.280 |

It is apparent from the above results that the light-sensitive materials having a harder highlight portion can be obtained with the emulsions according to the present invention without substantially lowering the sensitivities relative to a more conventional method.

Because of the provision of the silver bromide rich phase having less maximum silver bromide content at the first stage leads to the decrease in an inner defect to decrease a surface/inside competition, it is believed that Samples 105, 106, 110 and 111 of the invention provided a harder image compared with the other samples of the invention.

On the other hand, it is because the silver bromide content in the silver bromide rich phase formed at a plural time is higher than that of the silver bromide rich phase formed at the preceding time that among Samples 102 to 111, that the gradation is harder in Samples 103 to 111 than in Sample 102. In contrast, it can be seen that in Samples 112 and 114 in which there are used the silver halide emulsions L and N prepared by providing a second supply of bromine and/or a bromine ion before the formation of the silver bromide rich phase was complete by 80% in the first phase, not only was the sensitivity lowered to a large extent, but the gradation is softened compared with Sample 101, as well.

Thus, in the light-sensitive materials according to the present invention, a "clearance" in a highlight portion is improved because a gradation in the highlight portion is hardened.

EXAMPLE 2

There was prepared a multilayered color photographic paper having the following layer structure on a paper support laminated on the both sides thereof with polyethylene.

The coating solutions were prepared by mixing an emulsion, various chemicals and an emulsified dispersion of a coupler. The preparation methods thereof are shown below.

The Ppreparation of a Coupler Emulsion

Ethyl acetate 27.2 ml and the solvent (Solv-1) 7.7 ml were added to a yellow coupler (ExY) 19.1 g and a dye image stabilizer (Cpd-1) 4.4 g to dissolve them, and this solution was emulsified and dispersed in a 10% gelatin aqueous solution 185 ml containing a 10% sodium dodecylbenzenesulfonate 8 ml.

The respective emulsions for coating the magenta, cyan and intermediate layers were prepared in the same manner. The compounds for preparing the respective emulsions are shown below:

(ExY) yellow coupler
1:1 (by mol) mixture of
the following compounds:

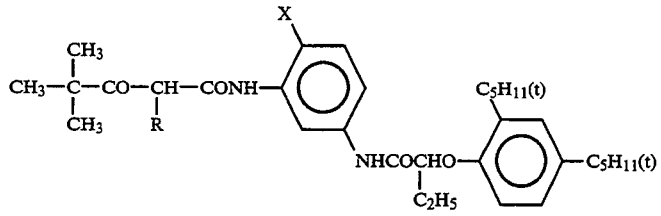

R =

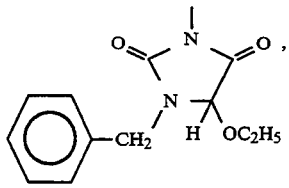

X = Cl and

R =

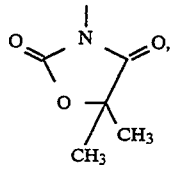

X = $OCH_3$ (ExM1) magenta coupler

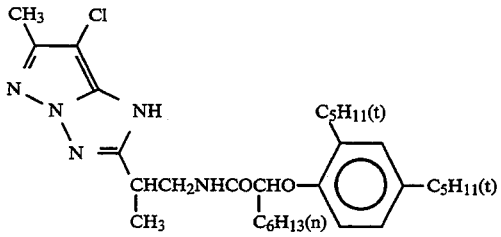

(ExM2) magenta coupler

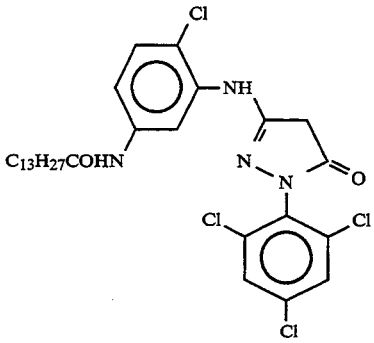

-continued
(ExM3) magenta coupler
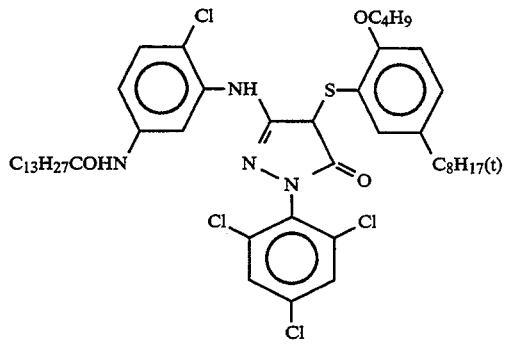
(ExM4) magenta coupler
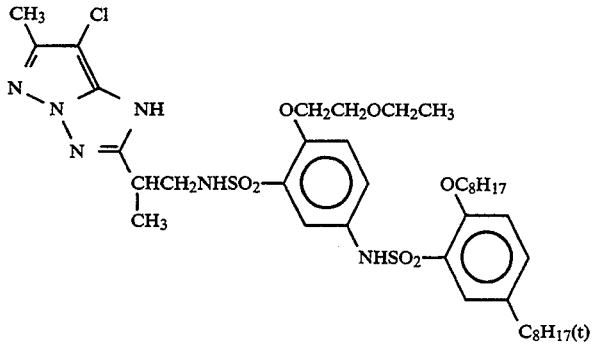
(ExC1) cyan coupler
1:1 (by mol) mixture of
the following compounds:
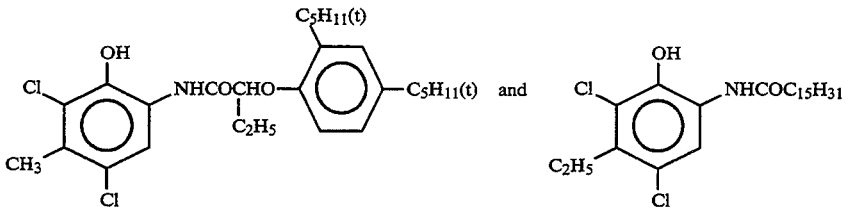
(ExC2) cyan coupler
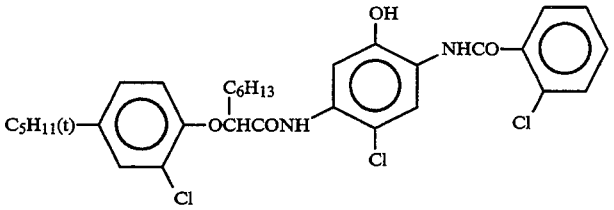
(ExC3) cyan coupler
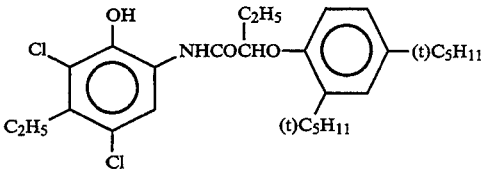
(ExC4) cyan coupler
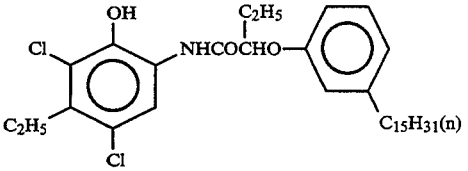

-continued
(Cpd-1) dye image stabilizer
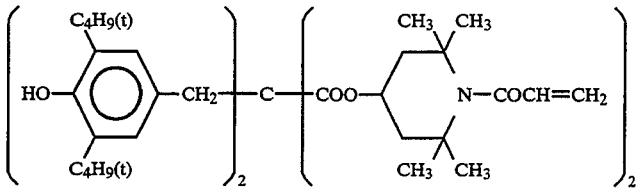
(Cpd-2) dye image stabilizer
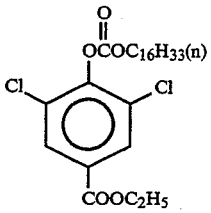
(Cpd-3) dye image stabilizer
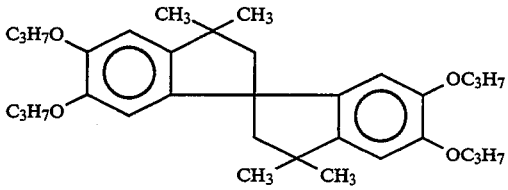
(Cpd-4) dye image stabilizer
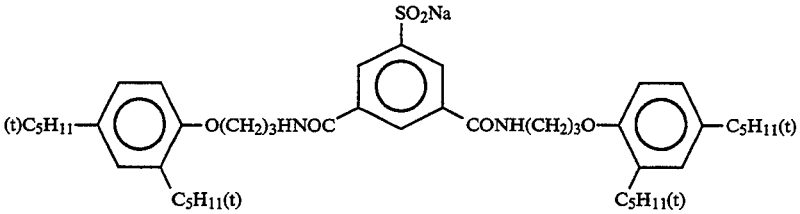
(Cpd-5) anti-color mixing agent
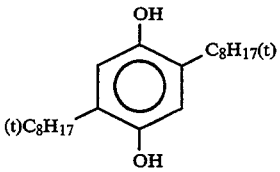
(Cpd-6) dye image stabilizer 2:4:4 (by weight) mixture of the following compounds:
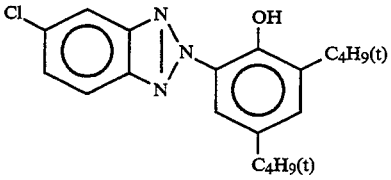
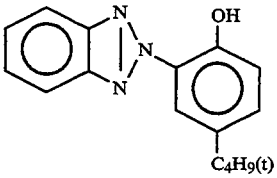
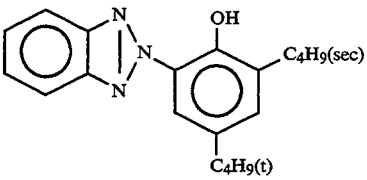

-continued
(Cpd-7) dye image stabilizer
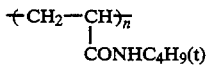
(average molecular weight 60,000)
(Cpd-8) dye image stabilizer
1:1 (by weight) mixture of
the following compounds:
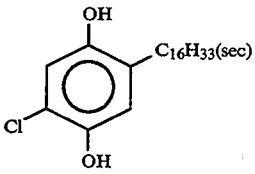
and
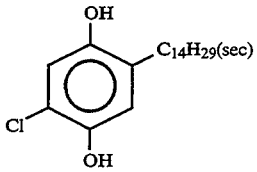
(Cpd-9) dye image stabilizer
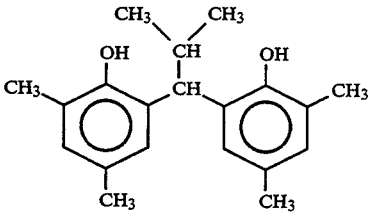
(Cpd-10) preservative
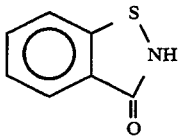
(Cpd-11) preservative
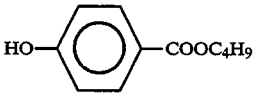
(UV-1) UV absorber
4:2:4 (by weight) mixture of
the following compounds:
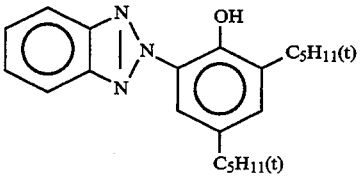
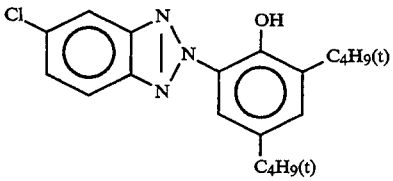
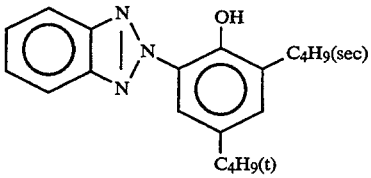
(Solv-1) solvent
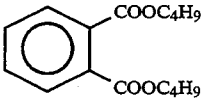
(Solv-2) solvent
1:1 (by volume) mixture of
the following compounds:
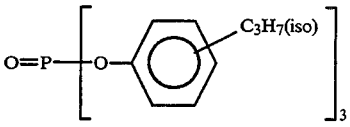
and -continued

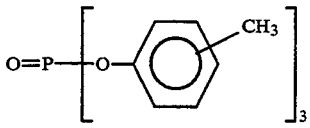

(Solv-3) solvent $O{=}P{+}O{-}C_9H_{19}(iso)]_3$ (Solv-4) solvent

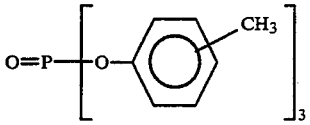

(Solv-5) solvent

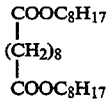

(Solv-6) solvent
80:20 (by volume) mixture of the following compounds:

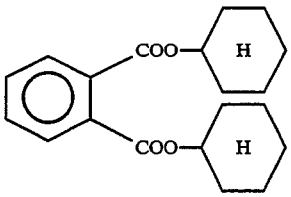

and

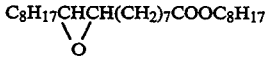

(Solv-7) solvent

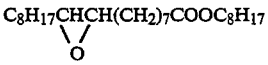

The following stabilizer was added to a blue-sensitive emulsion layer in an amount of $2.5\times10^{-4}$ mole per mole of silver halide.

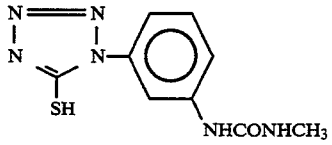

Sodium 1-oxy-3,5-dichloro-s-triazine was used as a gelatin hardener for the respective layers.

The following dyes were added to the emulsion layers for the purpose of preventing an irradiation.

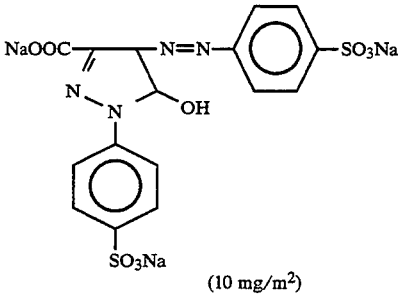

(10 mg/m$^2$)

-continued

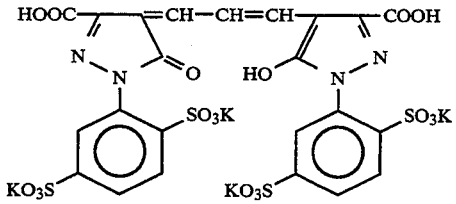

(10 mg/m²)

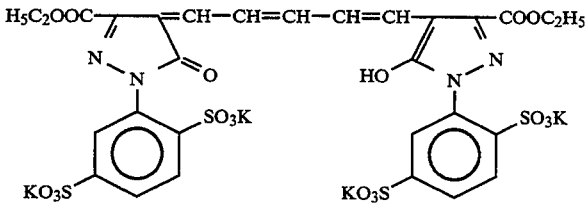

(40 mg/m²)

and

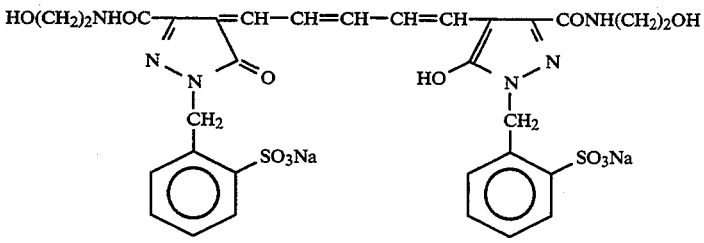

(20 mg/m²)

The following compound was added to a red-sensitive emulsion layer in an amount of $2.6\times10^{-3}$ mole per mole of silver halide.

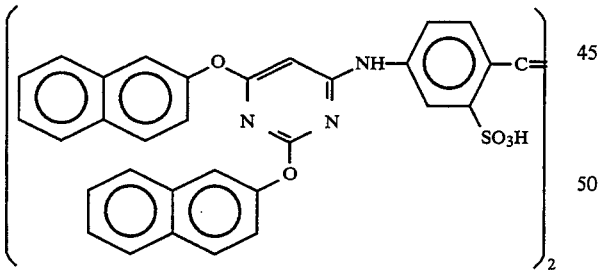

Emulsions (A), (J) and (K) each prepared in Example 1 were used as a red-sensitive emulsion. Provided that above CR-32 was added to Emulsion (A) in an amount of $1.5\times10^{-4}$ mole per mole of silver halide.

The green-sensitive emulsions (O), (P) and (Q) were prepared in the same manner as the red-sensitive emulsions (A), (J) and (K), except that the sensitizing dye used as a CR compound was replaced with above CR-24 of an addition amount of $4\times10^{-4}$ mole per mole of silver halide and that the same stabilizer as that used for the blue-sensitive layer was added in an amount of $5\times10^{-4}$mole per mole of silver halide.

The blue-sensitive emulsions (R), (S) and (T) were prepared in the following manner:

| The formation of the sliver chloride host grains | |
|---|---|
| Solution 1 | |
| Water | 1000 ml |
| NaCl | 5.5 g |
| Gelatin | 32 g |
| Solution 2 | |
| Sulfuric acid (1N) | 24 ml |
| Solution 3 | |
| Following compound A (1% by weight) 1,3-dimethyl-2-imidazolidinethione | 3 ml |
| Solution 4 | |
| NaCl | 1.7 g |
| Water was added to make the total quantity | 200 ml |
| Solution 5 | |
| $AgNO_3$ | 5 g |
| Water was added to make the total quantity | 200 ml |
| Solution 6 | |
| NaCl | 41.3 g |
| $K_2IrCl_5$ (0.001%) | 0.5 ml |
| Water was added to make the total quantity | 600 ml |
| Solution 7 | |
| $AgNO_3$ | 120 g |
| Water was added to make the total quantity | 600 ml |

Solution 1 was heated to 76° C. and Solutions 2 and 3 were added thereto. Further, after 10 minutes, Solutions 6 and 7 were simultaneously added over a period of 35 minutes. Five minutes after the addition, the temperature was lowered and the solution was desalted. Water and gelatin for dispersing were added and the pH was adjusted to 6.3, whereby there was obtained the monodispersed cubic silver chloride emulsion having an average grain size of 1.1 μm and a fluctuation coefficient (a value obtained by dividing a standard deviation of the grain sizes with an average grain size) of 0.10.

A 0.6% solution 12.6 ml of a spectral sensitizing dye (above CR-7) for a blue color was added to this emulsion as the CR compound. Further, an AgBr ultra fine grain emulsion having an average grain size of 0.05 μm was added thereto in a proportion of 0.5 mol % based on the AgCl host grains to provide a ripening at 58° C. for 10 minutes. Afterwards, sodium thiosulfate was added to provide an optimum chemical sensitization and the above stabilizer was added in an amount of $10^{-4}$ mole/mole of Ag, whereby Emulsion (R) was prepared.

Further, in place of the AgBr ultra fine grain emulsion having an average grain size of 0.05 μm, which was used for preparing Emulsion (R), a silver bromochloride fine grain emulsion having an average grain size of 0.05 μm and a silver bromide content of 60 mol % was added at 58° C. in terms of a silver amount of 0.09 mole to provide a ripening for 4 minutes to thereby form a silver bromide rich phase in a vicinity of an apex of the silver chloride host grain, and then the silver bromide fine grains having an average grain size of 0.05 μm was added at 58° C. in terms of a silver amount of 0.0025 mole to provide a ripening for 12 minutes, whereby Emulsion (S) was prepared.

Emulsion (S) is the emulsion in which bromine used for forming a silver bromide rich phase at the second time was supplied after the formation of the sliver bromide rich phase by supplying bromine the first time was finished by 85%.

These emulsions were combined as shown in Table 4 and coated to thereby prepare Samples 201 to 208. The couplers were all replaced in an equimolar conversion.

TABLE 4

| Sample | First layer | | Third layer | | Fifth layer | |
|---|---|---|---|---|---|---|
| No. | Em | Coupler | Em | Coupler | Em | Coupler |
| 201 | (R) | ExY | (O) | ExM1 | (A) | ExC1 and C2* |
| 202 | (R) | ExY | (P) | ExM1 | (J) | ExC1 and C2* |
| 203 | (R) | ExY | (P) | ExM1 | (K) | ExC1 and C2* |
| 204 | (R) | ExY | (P) | ExM2 | (J) | ExC4 |
| 205 | (S) | ExY | (Q) | ExM3 | (J) | ExC3 |
| 206 | (S) | ExY | (Q) | ExM4 | (J) | ExC1 |
| 207 | (S) | ExY | (P) | ExM4 | (K) | ExC4 |
| 208 | (S) | ExY | (Q) | ExM4 | (K) | ExC1 |

*Blend in a weight ratio of 1:1.

Layer Constitution

The compositions of the respective layers are shown below. The numerals represent the coated amounts (g/m²). The coated amounts of the silver halide emulsions are expressed in terms of the amounts converted to silver.

Support

Polyethylene laminated paper (polyethylene coated on the 1st layer side contains a white pigment/$TiO_2$ and a blue dye/ultramarine).

| | |
|---|---|
| First layer: a blue-sensitive yellow color developing layer | |
| Silver halide emulsion (Table 4) | 0.30 |
| Gelatin | 1.22 |
| Yellow coupler (Table 4) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| Second layer: an anti-color mixing layer | |
| Gelatin | 0.64 |
| Anti-color mixing agent (Cpd-5) | 0.10 |
| Solvent (Solv-1) | 0.16 |
| Solvent (Solv-4) | 0.08 |
| Third layer: a green-sensitive magenta color developing layer | |
| Silver halide emulsion (Table 4) | 0.12 |
| Gelatin | 1.28 |
| Magenta coupler (Table 4) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Fourth layer: a UV absorbing layer | |
| Gelatin | 1.41 |
| UV absorber (UV-1) | 0.47 |
| Anti-color mixing agent (Cpd-5) | 0.05 |
| Solvent (Solv-5) | 0.24 |
| Fifth layer: a red-sensitive cyan color developing layer | |
| Silver halide emulsion (Table 4) | 0.23 |
| Gelatin | 1.04 |
| Cyan coupler (Table 4) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| Sixth layer: a UV absorbing layer | |
| Gelatin | 0.48 |
| UV absorber (UV-1) | 0.16 |
| Anti-color mixing agent (Cpd-5) | 0.02 |
| Solvent (Solv-5) | 0.08 |
| Seventh layer: a protective layer | |
| Gelatin | 1.10 |
| Acryl-modified copolymer of polyvinyl alcohol (a modification degree: 17%) | 0.17 |
| Liquid paraffin | 0.03 |

Cpd-10 and Cpd-11 were added as a preservative to the above respective layers so that the total amounts became 25.0 mg/m² and 50.0 mg/m², respectively.

Samples 201 to 208 thus obtained were subjected to the same color development processing as Example 1 and the gradations in the blue, green and red-sensitive layers were compared in the same evaluation manner as Example 1. The results thus obtained are shown in Table 5.

As is apparent from the results summarized in Table 5, the gradations of the green-sensitive layer and red-sensitive layer in Samples 202 to 208 of the invention are markedly hardened in comparison with that of comparative Sample 201. Further, it can be seen that the gradations of the blue-sensitive layers in Samples 205 to 208 in which Emulsion (S) prepared by the method according to the present invention is used are markedly hardened in comparison with those of Samples 201 to 204 in which Emulsion (R) for a comparison was used.

TABLE 5

| | (Gradation) | | |
|---|---|---|---|
| Sample No. | Blue-sensitive layer | Green-sensitive layer | Red-sensitive layer |
| 201 (Comp.) | 0.201 | 0.220 | 0.270 |
| 202 (Inv.) | 0.201 | 0.180 | 0.250 |

TABLE 5-continued

| Sample No. | (Gradation) Blue-sensitive layer | Green-sensitive layer | Red-sensitive layer |
|---|---|---|---|
| 203 (Inv.) | 0.201 | 0.182 | 0.243 |
| 204 (Inv.) | 0.201 | 0.183 | 0.239 |
| 205 (Inv.) | 0.180 | 0.177 | 0.250 |
| 206 (Inv.) | 0.180 | 0.176 | 0.246 |
| 207 (Inv.) | 0.180 | 0.183 | 0.242 |
| 208 (Inv.) | 0.180 | 0.177 | 0.241 |

Thus, there can be obtained by the method according to the present invention, a silver halide emulsion capable of providing an image having a notably improved clearance in a highlight portion while maintaining a high sensitivity.

While the invention has been described in detail and with reference to specific embodiments thereof, it will be apparent to one skilled in the art that various changes and modifications can be made therein without departing from the spirit and scope of the invention.

What is claimed is:

1. A method for preparing a silver halide emulsion, said method comprising supplying bromine and/or bromine ion at a plurality of processing stages to silver halide host grains to form a phase rich in silver bromide in the vicinity of the apexes of the grains, said host grains being substantially of a cube or tetradecahedron and having a silver chloride content of about 95 mole % or more and a silver bromide content of about 0 to about 5 mole %; wherein the bromine and/or bromine ion is supplied at the plurality of stages by adding and mixing in a reaction vessel at least one of (i) a water soluble bromine compound, (ii) silver halide grains having a smaller average grain size and a larger silver bromide content than the silver halide host grains, and (iii) a bromine or bromine ion precursor represented by formula (S):

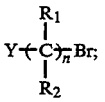

(S)

wherein Y represents an organic group having a Hammett's $\sigma_p$ value of 0 or more; $R_1$ and $R_2$, which may be the same or different, are selected from hydrogen, alkyl groups, alkenyl groups, aralkyl groups, aryl groups, or an organic group as defined by Y, with the proviso that $R_1$and Y may combine to form a heterocyclic ring; and n is an integer of 1 to 3; and where in at least one stage of said plurality of processing stages the bromine and/or bromine ion is supplied when the formation of the silver bromide-rich phase is at least 80% complete in the previous stage.

2. A method according to claim 1, where in said one stage of said plurality of processing stages, after treatment in that stage the proportion of silver bromide in silver bromide rich phase is higher than the proportion of silver bromide in the silver bromide-rich phase after treatment in a previous stage.

3. A method according to claim 2, wherein the proportion is at least 5 mole % higher after treatment in the latter stage.

4. A method according to claim 1, wherein after treatment by supplying bromine and/or bromine ion at said plurality of processing stages, the silver bromide-rich phase comprises from about 30 to 70 mole % silver bromide.

5. A silver halide emulsion prepared according to the method of claim 4.

6. A method according to claim 4, wherein the silver bromide-rich phase comprises from about 35 to about 60 mole % silver bromide.

7. A method according to claim 1, comprising supplying the bromine and/or bromine ion to at least one of said plurality of stages by adding and mixing a water soluble bromine compound.

8. A method according to claim 7, wherein the water soluble bromine compound is potassium bromide.

9. A method according to claim 1, comprising supplying the bromine and/or bromine ion to at least one of said plurality of stages by adding and mixing silver halide grains having a smaller average grain size and higher silver bromide content, than the silver halide host grains.

10. A method according to claim 9, comprising adding silver halide grains having a smaller average grain size and higher silver bromide content, than the silver halide host grains, the bromide concentration of the added grains being at least about 50 mole %.

11. A method according to claim 10, wherein the bromide concentration of the added grains is at least about 70 mole %.

12. A method according to claim 1, comprising supplying the bromine and/or bromine ion to at least one of said plurality of stages by adding a bromine or bromine ion precursor represented by formula (S).

13. A method according to claim 12, wherein formula (S) Y is a halogen atom, trifluoromethyl, cyano, formyl, carboxylic acid, sulfonic acid, carbamoyl, acyl, oxycarbonyl, sulfonyl, sulfonyloxy, carbonyloxy, sulfamoyl, or heterocyclic group.

14. A method according to claim 12, wherein formula (S) Y is a cyano, carboxylic acid, carbamoyl, acyl, sulfonyl oxycarbonyl, sulfamoyl or heterocyclic group; $R_1$ and $R_2$ which may be the same or different, are each selected from a hydrogen atom, and those groups which Y represents; and n is 1 or 2.

15. A method according to claim 12, wherein the precursor of formula (S) is added in an amount of from 0.2 to 3 mole % based on the amount of silver halide in the emulsion.

16. A method according to claim 1, wherein the bromine or bromine ion is added in an amount of from 0.1 to 5 mole % based on the amount of silver halide in the emulsion.

17. A method according to claim 16, wherein the bromine or bromine ion is added in an amount of from 0.1 to 1.5 mole % based on the amount of silver halide in the emulsion.

18. A method according to claim 1, comprising the use of at least one CR compound which has a function to selectively adsorb on a specific crystal plane to delay or entirely prevent the initiation of halogen conversion and recrystallization in comparison with the case in which said CR compound does not adsorb.

19. A method according to claim 18, wherein said CR compound is a cyanine dye, a merocyanine dye, a mercaptoazole or a nucleic acid decomposition product.

20. A method according to claim 1, comprising supplying bromine and/or bromine ion at two processing stages.

21. A method according to claim 1, comprising supplying bromine and/or bromine ion at three processing stages.

22. A method according to claim 1, comprising forming a silver bromide-rich phase on a silver halide host grain being substantially of a cube or a tetradecahedron, said silver bromide-rich phase being formed on the corner of the host grain.

23. A silver halide emulsion prepared according to the method of claim 1.

24. A silver halide color photographic light-sensitive material comprising, on a support, at least one silver halide emulsion according to claim 23.

25. A silver halide color photographic light-sensitive material according to claim 24, wherein said support is a reflection support.

26. A silver halide color photographic material comprising, on a reflection support, at least one yellow color developing silver halide emulsion layer, at least one magenta color developing silver halide emulsion layer, and at least one cyan color developing silver halide emulsion layer, wherein at least one of the yellow, magenta or cyan color developing silver halide emulsions contains a silver halide emulsion according to claim 23.

* * * * *